US008287121B2

(12) United States Patent
Kobayashi

(10) Patent No.: US 8,287,121 B2
(45) Date of Patent: Oct. 16, 2012

(54) INKJET RECORDING MEDIUM AND METHOD OF PRODUCING SAME

(75) Inventor: Masamichi Kobayashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 120 days.

(21) Appl. No.: 12/874,237

(22) Filed: Sep. 2, 2010

(65) Prior Publication Data

US 2011/0058006 A1 Mar. 10, 2011

(30) Foreign Application Priority Data

Sep. 10, 2009 (JP) ..... 2009-209816
Sep. 29, 2009 (JP) ..... 2009-224453

(51) Int. Cl.
*B41J 3/407* (2006.01)
*B05D 1/36* (2006.01)

(52) U.S. Cl. ..... 347/106; 427/419.1

(58) Field of Classification Search ..... None
See application file for complete search history.

(56) References Cited

FOREIGN PATENT DOCUMENTS

| | | | |
|---|---|---|---|
| JP | 2002-192830 | A | 7/2002 |
| JP | 2002-316480 | A | 10/2002 |
| JP | 2005-212358 | A | 8/2005 |
| JP | 2005-313490 | A | 11/2005 |

*Primary Examiner* — Stephen Meier
*Assistant Examiner* — Alexander C Witkowski
(74) *Attorney, Agent, or Firm* — Solaris Intellectual Property Group, PLLC

(57) ABSTRACT

The present invention provides an inkjet recording medium having at least an ink-receiving layer, the ink-receiving layer containing at least fumed silica, a hydroxycarboxylic acid ester having the I/O value of 1.5 or more as determined in accordance with an organic conceptual diagram, and a polyvinyl alcohol, and an amount of the hydroxycarboxylic acid ester with respect to 1 kg of the fumed silica in the ink-receiving layer being from 0.1 moles to 2 moles. The present invention further provides an inkjet recording medium having at least a support and an ink-receiving layer provided on the support, the ink-receiving layer containing at least a chloride ion-containing zirconium salt, a water-soluble aluminum salt, a hydroxy acid derivative, inorganic fine particles, and a water-soluble resin.

15 Claims, No Drawings

INKJET RECORDING MEDIUM AND METHOD OF PRODUCING SAME

CROSS-REFERENCE TO RELATED APPLICATION

This application claims priority under 35 USC 119 from Japanese Patent Application No. 2009-209816 filed on Sep. 10, 2009 and Japanese Patent Application No. 2009-224453 filed on Sep. 29, 2009, the disclosures of which are incorporated by reference herein

BACKGROUND

1. Field of the Invention

The present invention relates to an inkjet recording medium. The present invention further relates to a method of producing the recording medium.

2. Related Art

With recent development of various information-processing systems, inkjet-recording methods have come to be widely used because they allow printing on various recording materials, and the hardware (devices) therefor is compact and silent and is relatively reasonably priced.

Inkjet recording media, respectively having an ink-receiving layer (recording layer) having a porous structure, have been developed and out to practical use.

SUMMARY

Inkjet recording media having a recording layer which contains inorganic pigment particles and a water-soluble binder, has a high porosity, and is provided on a support have been proposed as recording materials which provide photograph-like images as a result of having properties such as excellent quick-drying property of an ink due to its porous structure and having high gloss.

In terms of the quality of the recording material, it is important that a high quality image having high density and high contrast which result in image contrast or clearness are obtained in addition to an ability to record a high gloss image with a quick-drying property, and deformation such as curling is not easily generated during the recording or thereafter.

In this regard, formation of an ink-receiving layer using fine particle dispersions containing hydroxy acids such as glycolic acid and lactic acid and a polyvinyl alcohol and the like in combination with alumina hydrate has been proposed (for example, see Japanese Patent Application Laid-Open (JP-A) No. 2005-313490). Further, a sheet for inkjet recording containing a carboxylic acid compound such as lactic acid or propionic acid has been proposed (for example, see JP-A No. 2002-316480).

In these conventional techniques involving use of glycolic acid, lactic acid, or the like as a hydroxy acid or a carboxylic acid compound, the viscosity of the layer-forming coating liquid may easily increase, and the density of a recorded image and the suppression of curling when placed in a low-humidity environment may be insufficient.

In addition, an inkjet recording medium in which an ink absorbing layer contains a zirconium compound or an aluminum compound and the pH of a film surface is from 4 to 6 has been proposed as causing little bleeding and having excellent color reproducibility (for example, see JP-A No. 2002-192830). Further, an inkjet recording medium in which an ink-receiving layer contains a zirconium compound and an aluminum compound has been proposed as suppressing bleeding and bronzing (for example, see JP-A No. 2005-212358).

However, there are cases in which the ink-receiving layer of the inkjet recording medium described in JP-A No. 2002-192830 or JP-A No. 2005-212358 generates an offensive odor or the ozone resistance may not be sufficient depending on the conditions of use.

The present invention has been made in consideration of these circumstances.

In a first aspect, the present invention provides an inkjet recording medium, an ink-receiving layer of which may be formed using a coating liquid having better conditions (such as the better viscosity), and which can provide a higher image density and can suppress curling under a low-humidity environment, as compared to conventional recording media, and a method for producing the same.

In a second aspect, the present invention provides an inkjet recording medium, which may suppress generation of the offensive odor from the ink-receiving layer and may have excellent ozone resistance and bronzing suppression, and a method for producing the same. Namely, one exemplary embodiment of the first aspect of the present invention is an inkjet recording medium comprising an ink-receiving layer, the ink-receiving layer comprising fumed silica, a hydroxycarboxylic acid ester having an I/O value of 1.5 or more as determined in accordance with an organic conceptual diagram, and a polyvinyl alcohol, and an amount of the hydroxycarboxylic acid ester with respect to 1 kg of the fumed silica in the ink-receiving layer being from 0.1 moles to 2 moles.

Another exemplary embodiment of the first aspect of the present invention is a method for forming the inkjet recording medium of the above exemplary embodiment of the first aspect of the present invention, the method comprising: adding the hydroxycarboxylic acid ester having an I/O value of 1.5 or more as determined in accordance with an organic conceptual diagram and the polyvinyl alcohol to a silica dispersion comprising the fumed silica to prepare a coating liquid in which the amount of the hydroxycarboxylic acid ester is from 0.1 moles to 2 moles with respect to 1 kg of the fumed silica; and applying the coating liquid to a support to form an ink-receiving layer.

One exemplary embodiment of the second aspect of the present invention is an inkjet recording medium comprising a support and an ink-receiving layer provided on the support, the ink-receiving layer comprising a chloride ion-containing zirconium salt, a water-soluble aluminum salt, a hydroxy acid derivative, inorganic fine particles, and a water-soluble resin.

Another exemplary embodiment of the second aspect of the present invention is a method for forming the inkjet recording medium of the above exemplary embodiment of the second aspect of the present invention, the method comprising: applying a coating liquid comprising the chloride ion-containing zirconium salt, the water-soluble aluminum salt, the hydroxy acid derivative, the inorganic fine particles, and the water-soluble resin to a support to form a coating layer; and applying a solution containing a basic compound to the coating layer, either (1) simultaneously with the application of the coating liquid or (2) before the applied coating liquid exhibits a falling-rate drying during drying of the applied coating liquid.

DETAILED DESCRIPTION

Inkjet recording media and methods for forming the inkjet recording media provided herein are explained below in detail. Explanations regarding configurations which are not specified as those of the first aspect or the second aspect are applicable to those of both of the aspects.

The invention provides, as one exemplary embodiment of the first aspect, an inkjet recording medium having at least an ink-receiving layer, the ink-receiving layer containing at least fumed silica, a hydroxycarboxylic acid ester having the I/O value of 1.5 or more as determined in accordance with an organic conceptual diagram, and a polyvinyl alcohol, and an amount of the hydroxycarboxylic acid ester with respect to 1 kg of the fumed silica in the ink-receiving layer being from 0.1 moles to 2 moles.

The inkjet recording medium of the first aspect uses a combination of fumed silica as an inorganic fine particle and a polyvinyl alcohol (which may be hereinafter abbreviated as "PVA",) as a binder component. In general, the combination of the fumed silica and PVA in a formulation of a coating liquid for forming a recording layer may tend to suffer from easy increase of liquid viscosity which is caused by the interaction between the fumed silica and the PVA and may lead interfering with liquid formability and coatability, and there may be cases where curling occurs upon recording after the formation of the layer or a desired image density cannot be obtained. In this regard, the inkjet recording medium of the first aspect contains a specific hydroxycarboxylic acid ester in combination with the fumed silica and the PVA. This configuration may provide desirable liquid conditions (such as viscosity) to the coating liquid for forming a recording layer, and may enable to provide a recording medium which can show higher image density and can suppress curling under a low-humidity environment as compared to a conventional medium.

In embodiments, the inkjet recording medium of the first aspect may have a support and at least one ink-receiving layer disposed on the support, and if desired, it may further contain other layers such as an undercoat layer.

The invention further provides, as one exemplary embodiment of the second aspect, an inkjet recording medium having at least a support and an ink-receiving layer provided on the support, the ink-receiving layer containing at least a chloride ion-containing zirconium salt, a water-soluble aluminum salt, a hydroxy acid derivative, inorganic fine particles, and a water-soluble resin.

Generally, an ink-receiving layer of an inkjet recording medium contains various additives for the purpose of obtaining good image quality. Examples of such an additive include a water-soluble inorganic salt which is added as an inorganic mordant, and examples of such a water-soluble inorganic salt include a compound containing volatile compounds such as acetic acid as a counter anion. An inkjet recording medium containing such an additive may generate an offensive odor derived from such volatile compounds depending on its conditions of use. In this regard, the inkjet recording medium of the second aspect may suppress the generation of the offensive odor, and excellent ozone resistance and suppression of bronzing may be also exhibited. Further, the coating liquid for forming the ink-receiving layer of the inkjet recording medium of the second aspect may suppress the increase of the viscosity by its formulation, thereby providing excellent preparation suitability.

Components of the ink-receiving layer of embodiments of inkjet recording media provided by the invention are explained below.

Hydroxycarboxylic Acid Ester

The ink-receiving layer of the inkjet recording medium of the first aspect contains at least one kind of hydroxycarboxylic acid ester having the I/O value of 1.5 or more as determined in accordance with the organic conceptual diagram. It is presumed that when the ink-receiving layer contains the hydroxycarboxylic acid ester, the interaction between the fumed silica and PVA is relieved.

The ink-receiving layer of the inkjet recording medium of the first aspect contains the hydroxycarboxylic acid ester in amounts from 0.1 moles to 2 moles with respect to 1 kg of the fumed silica. If the amount of the hydroxycarboxylic acid ester with respect to 1 kg of the fumed silica is less than 0.1 moles, the hydrophobic interaction between the hydroxycarboxylic acid ester adsorbed to a silanol group of the fumed silica and the acetyl group of PVA may increases and thus there may be cases where a desired liquid conditions (such as viscosity) may not be maintained. If the amount of the hydroxycarboxylic acid ester with respect to 1 kg of the fumed silica is greater than 2 moles, density of printed images may be remarkably reduced.

In embodiments, the amount of the hydroxycarboxylic acid ester with respect to 1 kg of the fumed silica may be preferably from 0.2 moles to 1.0 mole from the viewpoint of maintaining a desired liquid conditions (such as viscosity), and increasing the image density and the effect of suppression of curling under low humidity.

The hydroxycarboxylic acid ester used in the first aspect can contain one or two or more carboxyl groups (—COOH groups). In embodiments, in view of the effect of the first aspect, the number of the carboxyl groups in the molecule may be preferably from 0 to 1.

In embodiments, the hydroxycarboxylic acid ester used in the first aspect may be preferably a compound containing one or more hydroxyl groups (—OH groups, which are other than —OH in —COOH group) in the molecule. When the OH group(s) resides in the hydroxycarboxylic acid ester, the molecule of the hydroxycarboxylic acid ester may be adsorbed to a silanol group on the surface of the fumed silica, which can interfere with the interaction between the fumed silica and PVA, and accordingly, the effect of relieving the interaction therebetween may be enhanced.

The number of the OH groups in the molecule of the hydroxycarboxylic acid ester is not particularly limited. In embodiments, one or two OH groups may be preferably contained in the molecule.

The hydroxycarboxylic acid ester used in the first aspect has the I/O value of 1.5 or more as determined in accordance with an organic conceptual diagram. It is assumed that if this I/O value is less than 1.5, the hydrophobic interaction between the hydroxycarboxylic acid ester adsorbed to a silanol group of the fumed silica and the acetyl group of PVA may increase and therefor a desired liquid conditions (such as viscosity) cannot be maintained and the image density and the effect of suppression of curling under low humidity may be reduced.

The I/O value is a value obtained by taking the polarity of the various organic compounds with concept of organic chemistry, and is also referred to as an inorganicity value/organicity value. The method for obtaining the value is one of methods which assess contributions of functional groups of a compound to the polarity of the compound by applying parameters which are set for each of the functional groups. Details of the I/O value are described in Organic conceptual diagram (author: Yoshio Koda, (Sankyo Publishing Co., Ltd.) (1984)) and the like. The concept of the I/O value is expressing the properties of an organic compound by: dividing the organic compound into partial structures (such as functional groups, atoms, and bonds), each of the partial structures having an organicity value exhibiting a covalent bond-property and/or an inorganicity value exhibiting an ionic bond-property; obtaining the sum of organicity values of the partial structures of the organic compound and the sum of inorganicity values of the partial structures of the organic compound; and plotting, in a rectangular coordinate on the organicity axis and the inorganicity axis, a point having the sums as its coordinate.

The inorganicity value refers to a numerical value expressing the extent of effects of various substituents and bondings and the like contained in an organic compound to the boiling point of the organic compound by setting the extent of effects of a hydroxyl group as a basis. Specifically, the extent of effects of one hydroxyl group is set at a numerical value of 100, based on the fact that the distance between the boiling point curve of a linear alcohol and the boiling point curve of a linear paraffin which is taken with the number of carbon atoms at around 5 is about 100° C. A value which expresses the extent of effects of a substituent, a bond or the like of an organic compound on the boiling point of the organic compound in terms of a numerical value on the basis of the numerical value 100 set for one hydroxyl group as described above is taken as the inorganicity value of the substituent, the bond or the like of the organic compound. For example, the inorganicity value of a —COOH group is 150 and the inorganicity value of a double bond is 2. Accordingly, the inorganicity value of one organic compound means a sum of the inorganicity values of substituents, bonds, and the like contained in the organic compound.

The organicity value is set by regarding a methylene group in the molecule as a unit, and setting, as a standard, the extent of effects, on the boiling point, of a carbon atom representative of the methylene group. Specifically, the average increment of the boiling point achieved by addition of one carbon atom to a linear saturated hydrocarbon compound having approximately 5 to 10 carbon atoms is 20° C., and as a result, based on this, the organicity value of one carbon atom is set to 20. A value which expresses the extent of effects of a substituent, a bond or the like of an organic compound on the boiling point of the organic compound in terms of a numerical value on the basis of the numerical value 20 set for one carbon atom as described above is taken as the organicity value of the substituent, the bond or the like of the organic compound. For example, the organicity value of a nitro group (—$NO_2$) is 70.

The I/O value closer to 0 of an organic compound indicates that the organic compound has a higher non-polarity (high hydrophobicity or organicity), and a higher I/O value of an organic compound indicates that the organic compound has a higher polarity (high hydrophilicity or inorganicity).

The method for determine the I/O value of the hydroxycarboxylic acid ester used in the first aspect is as follows. In accordance with the organicity (O value) and the inorganicity (I value) described in "Organic conceptual diagram—Basis and Application—(1984), p. 13, edited by Yoshio Koda, the I/O value (I value/O value) of each of the compounds which form the hydroxycarboxylic acid ester is calculated. The I/O value and the mole percentage in the ester are multiplied with respect to each of the compounds which form the ester, and a sum of the multiplied results is yielded and rounded off to two decimals. The resulting value is taken as the I/O value of the hydroxycarboxylic acid ester.

The I/O value of the hydroxycarboxylic acid ester is 1.5 or more, and may be preferably 2 or more. The upper limit of the I/O value may be preferably 6.

Examples of the hydroxycarboxylic acid which forms the hydroxycarboxylic acid ester include glycolic acid, lactic acid, quinic acid, salicylic acid, 3,5-hydroxybenzoic acid, mevalonic acid, shikimic acid, 3,4,5-trihydroxybenzoic acid, 3-hydroxybutyric acid, glyceric acid, and Compounds 1 and 2 shown below.

Compound 1

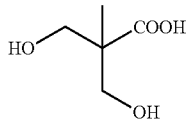

Compound 2

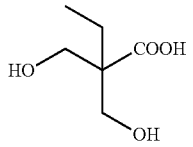

Examples of the alcohol which forms the hydroxycarboxylic acid ester include a linear or branched alcohol having 1 to 6 carbon atoms, preferably 1 to 4 carbon atoms such as methyl alcohol, ethyl alcohol, (n-, i-, t-) propyl alcohol, butyl alcohol, or hexyl alcohol.

Examples of the hydroxycarboxylic acid ester include: a glycolic acid ester, that is an ester (preferably having 3 to 8 carbon atoms) formed from a glycolic acid and an alcohol (preferably an alcohol having 1 to 4 carbon atoms), such as methyl glycolate or ethyl glycolate; and a lactic acid ester, that is an ester (preferably having 3 to 8 carbon atoms) formed from a lactic acid and an alcohol (preferably an alcohol having 1 to 4 carbon atoms), such as methyl lactate or ethyl lactate.

In embodiments, in the first aspect, the hydroxycarboxylic acid ester may preferably contain an OH group in its molecule and have the I/O value of from 1.5 to 10 as determined in accordance with an organic conceptual diagram, and an amount of the hydroxycarboxylic acid ester with respect to 1 kg of the fumed silica may be preferably from 0.1 moles to 2.0 moles.

Chloride Ion-Containing Zirconium Salt

In the second aspect, the ink-receiving layer contains at least one chloride ion-containing zirconium salt. The chloride ion-containing zirconium salt is not particularly limited as long as it is a zirconyl compound (oxyzirconium compound) containing at least one chloride ion. In embodiments, it may be preferably selected from zirconium oxychloride ($ZrOCl_2$) and zirconyl hydroxychloride (ZrO(OH)Cl).

The content of the chloride ion-containing zirconium salt in the ink-receiving layer of the inkjet recording medium of the second aspect is not particularly limited. In embodiments, from the viewpoint of suppressing the bronzing, the mass ratio of the content of the chloride ion-containing zirconium salt to the content of the inorganic fine particles described below (chloride ion-containing zirconium salt/inorganic fine particles) may be preferably from 0.001 to 0.1, more preferably from 0.01 to 0.05, and even more preferably from 0.01 to 0.04.

Hydroxy Acid Derivative

The ink-receiving layer in the second aspect contains at least one hydroxy acid derivative. The inclusion of the hydroxy acid derivative in addition to the chloride ion-containing zirconium salt may facilitate to effectively suppress an increase of the viscosity of the coating liquid for forming the ink-receiving layer and an occurrence of bronzing in the inkjet recording medium.

The hydroxy acid derivative is not particularly limited as long as it is a compound having at least one hydroxyl group and at least one acidic functional group in one molecule. In embodiments, the acidic functional group may form an ester. Examples of the acidic functional group include a carboxy group, a sulfonic acid group, and a phosphoric acid group. In embodiments, a carboxy group may be preferable from the viewpoint of suppressing offensive odors and suppressing an increase of the viscosity.

In embodiments, if the acidic functional group forms an ester, the ester may be preferably an ester formed from an alcohol having 1 to 6 carbon atoms and the acidic functional group, and more preferably an ester formed from an alcohol having 1 to 3 carbon atoms and the acidic functional group, from the viewpoint of suppressing offensive odors and suppressing an increase of the viscosity.

The number of the hydroxyl groups contained in the hydroxy acid derivative is not particularly limited. In embodiments, it may be preferably from 1 to 6, and more preferably from 1 to 4. In embodiments, the number of the acidic functional groups of the hydroxy acid derivative may be preferably from 1 to 2, and more preferably 1, from the viewpoint of suppressing an increase of the viscosity.

In embodiments, the hydroxy acid derivative in the second aspect may be preferably a monovalent or divalent carboxylic acid having 2 to 10 carbon atoms and from 1 to 4 hydroxyl groups or an ester of the monovalent or divalent carboxylic acid, and more preferably a monovalent carboxylic acid having 2 to 8 carbon atoms and from 1 to 4 hydroxyl groups, from the viewpoint of suppressing offensive odors and suppressing an increase of the viscosity.

Specific examples of the hydroxy acid derivative include hydroxy acids such as lactic acid (including a D-isomer, an L-isomer, and a mixture thereof at an arbitrary ratio), glycolic acid, quinic acid, 2,2-bis(hydroxymethyl)propionic acid, 2,2-bis(hydroxymethyl)butanoic acid, glyceric acid, shikimic acid, and mevalonic acid, and hydroxy acid esters such as methyl lactate, ethyl lactate, methyl glycolate, and ethyl glycolate. In embodiments, the hydroxy acid derivative may preferably contain at least one selected from the group consisting of lactic acid (including a D-isomer, an L-isomer, and a mixture thereof at an arbitrary ratio), glycolic acid, quinic acid, 2,2-bis(hydroxymethyl)propionic acid, 2,2-bis(hydroxymethyl)butanoic acid, and glyceric acid, and esters thereof, and may more preferably contain at least one selected from lactic acid (including a D-isomer, an L-isomer, and a mixture thereof at an arbitrary ratio), glycolic acid, and quinic acid.

The content of the hydroxy acid derivative in the ink receiving layer of the inkjet recording medium of the second aspect is not particularly limited. In embodiments, from the viewpoint of suppressing offensive odors and suppressing an increase of the viscosity of the coating liquid, the mass ratio of the content of the hydroxy acid derivative to the content of the chloride ion-containing zirconium salt (hydroxy acid derivative/chloride ion-containing zirconium salt) may be preferably from 0.01 to 5, and more preferably from 0.03 to 3.

In embodiments, in the ink-receiving layer of the inkjet recording medium of the second aspect, it may be preferable that the mass ratio of the chloride-containing zirconium salt to the inorganic fine particles is from 0.001 to 0.1 and the mass ratio of the monovalent or divalent carboxylic acid having 2 to 10 carbon atoms and from 1 to 4 hydroxyl groups or an ester thereof to the chloride ion-containing zirconium salt is from 0.01 to 5, and it may be more preferable that the mass ratio of the chloride-containing zirconium salt selected from zirconium oxychloride and zirconyl hydroxychloride to the inorganic fine particles is from 0.01 to 0.05 and the mass ratio of the monovalent carboxylic acid having 2 to 8 carbon atoms and from 1 to 4 hydroxyl groups to the chloride ion-containing zirconium salt is from 0.03 to 1, from the viewpoint of suppressing bronzing, suppressing offensive odors, and suppressing an increase of the viscosity of the coating liquid.

Inorganic Fine Particles

The ink-receiving layer contains inorganic fine particles.

Examples of suitable inorganic fine particles include silica fine particles, colloidal silica, titanium dioxide, barium sulfate, calcium silicate, zeolites, kaolinite, halloysite, mica, talc, calcium carbonate, magnesium carbonate, calcium sulfate, boehmite alumina, and pseudoboehmite alumina. Among them, silica fine particles is preferable.

Since silica fine particles have an especially high specific surface area, an ink-receiving layer containing silica fine particles may efficiently absorb and retain ink. Further, because a refractive index of silica fine particles is low, an ink-receiving layer containing silica fine particles may be imparted with transparency, high color density and good coloring ability, provided that the silica fine particles are dispersed in the ink-receiving layer to have an adequate fine particle diameter. Such a transparency of the ink-receiving layer may be useful for obtaining high color density and good coloring ability and gloss, which may be desired in applications to a recording sheet such as a photoglossy paper as well as in applications requiring transparency such as OHP.

In general, silica fine particles are classified roughly into wet-method particles and dry-method (vapor-phase-method) particles depending on the production method therefor. In the wet method, generally, a silicate salt is decomposed with an acid to produce an active silica, and the active silica is polymerized to a suitable extent to cause aggregation-precipitation to obtain hydrous silica. The vapor-phase methods are classified roughly into the flame hydrolysis process and the arc method. In the flame hydrolysis process, generally, a silicon halide is hydrolyzed in a vapor phase at high temperature to form anhydrous silica fine particles; and in the arc method, generally, quartz and coke are reduced and vaporized in an electric furnace by applying arc discharge, followed by air oxidation, to thereby form anhydrous silica fine particles. The "fumed silica" herein refers to anhydrous silica fine particles produced by the vapor-phase method.

The fumed silica have different properties from the hydrous silica. For example, the f fumed silica contains voids unlike the hydrous silica, and they are also different in the density of silanol groups present on the surface. The fumed silica is suitable for forming a three-dimensional structure with high void volume ratio. The reason for this is supposed as follows: hydrous silica fine particles have a higher density of silanol groups present on their surfaces (about 5 groups/$nm^2$ to 8 groups/$nm^2$), leading to dense gathering (aggregation); in contrast, fumed silica fine particles have a lower density of silanol groups present on their surfaces (about 2 groups to 3 groups/$nm^2$), leading to loose gathering (flocculation) and thus forming a three-dimensional structure with high void volume ratio.

Specifically, the ink-receiving layer of the inkjet recording medium of the first aspect contains fumed silica as an inorganic fine particle. In the first aspect, the use of the fumed silica as an inorganic fine particle in a mixture with PVA described below may facilitate to maintain a desired liquid conditions (such as viscosity) of a coating liquid for forming the ink-receiving layer, and to increase the image density of the inkjet recording medium and to suppress curling of the inkjet recording medium which may easily occur under low humidity.

In embodiments, in the inkjet recording medium of the second aspect, the ink-receiving layer may preferably contain fumed silica as the inorganic fine particles.

The fumed silica may be preferably silica fine particles having a density of silanol groups present on their surfaces of from 2 groups/$nm^2$ to 3 groups/$nm^2$. The specific surface area of the fumed silica fine particles, measured by a BET method, may be from 200 $m^2/g$ or more. The specific surface area of the fumed silica measured by a BET method may be further preferably from 250 $m^2/g$ or more, and particularly preferably from 380 $m^2/g$ or more. When the specific surface area is 200 $m^2/g$ or more, the ink-receiving layer may have high in transparency and high printing density.

The BET method is described in item 2.2 the technical information No. 10 available from Japan Aerosil Co., Ltd. and the like as a method for measuring an average particle diameter of primary particles. The BET method is one of methods for measuring a surface area of a powder by a vapor-phase adsorption method. This method finds a total surface area of 1 g of a sample, that is, a specific surface area from an adsorption isotherm. Nitrogen gas is most often used as the adsorption gas, and the adsorbed amount of gas is most often measured from the pressure or volume variations of the adsorption gas. An equation suggested by Brunauer, Emmett, and Teller, which is called a BET equation, is the most famous equation representing an isotherm of multimolecular adsorption and it is widely used for determining the surface area. A surface area can be found by finding the adsorption amount based on the BET equation and multiplying by the area taken by one adsorbed molecule on the surface.

An average primary particle diameter of the inorganic fine particles may be preferably 20 nm or less, more preferably 15 nm or less, and further preferably 10 nm or less. When the average primary particle diameter is 20 nm or less, high ink-absorbing speed of the ink-receiving layer may be effectively improved, and glossiness of a surface of the ink-receiving layer may be also improved.

Specifically, silica fine particles are easier to stick to one another due to hydrogen bonds formed by silanol groups on the surfaces thereof and the adhering effect via the silanol groups and the water-soluble resin (such as polyvinyl alcohols). Therefore, the ink-receiving layer may have a structure having a high void volume ratio and high transparency when the average primary particle diameter of the inorganic fine particles may be preferably 20 nm or less, thereby effectively improving ink-absorbability.

The content of the fumed silica may be preferably from 50% by mass, and more preferably from 60% by mass, with respect to the total solid content of the ink-receiving layer. When the content of the fumed silica satisfies such range, the porous structure of the ink-receiving layer may be improved, which may lead to excellent ink absorption property.

The "total solid content of the ink-receiving layer" herein means a content calculated based on components which form the ink-receiving layer except for water.

Water-Soluble Resin

The ink-receiving layer contains a water-soluble resin.

Examples of the water-soluble resin include resins having a hydroxyl group as a hydrophilic structural unit such as polyvinyl alcohols (PVA), acetoacetyl-modified polyvinyl alcohols, cationic modified polyvinyl alcohols, anionic modified polyvinyl alcohols, silanol-modified polyvinyl alcohols and polyvinylacetals, cellulose resins (e.g., methyl cellulose (MC), ethyl cellulose (EC), hydroxyethyl cellulose (HEC), hydroxypropyl cellulose (HPC), and carboxymethyl cellulose (CMC)), chitins, chitosans, and starch; ether bond-containing resins (e.g., polypropylene oxide (PPO), polyethylene glycol (PEG), and polyvinyl ether (PVE)); and resins having an amide group or an amide bond as a hydrophilic structural unit (e.g., polyacrylamide (PAAM) and polyvinyl pyrrolidone (PVP)). Examples of the water-soluble resin further include compounds having a carboxyl group as a dissociative group (e.g., polyacrylic acid salts, maleic acid resins, alginic acid salts and gelatins).

Among these, polyvinyl alcohol resins may be particularly preferable.

Examples of the polyvinyl alcohols (PVA) include polyvinyl alcohol, acetoacetyl-modified polyvinyl alcohols, cationic modified polyvinyl alcohols, anionic modified polyvinyl alcohols, silanol-modified polyvinyl alcohols and polyvinylacetals. One of the PVA may be used singly or two or more kinds thereof may be used in combination.

The number-average polymerization degree of the PVA may be preferably 1800 or more, and more preferably 2000 or more. When the PVA is used in combination with silica fine particles, the kind of the water-soluble resin may be selected in consideration of obtaining transparency. Specifically, when anhydrous silica fine particles are used, the water-soluble resin may be preferably PVA, and more preferably PVA having a saponification degree of from 70% to 99%.

Specifically, the ink-receiving layer of the inkjet recording medium of the first aspect contains at least one PVA.

In embodiments of the ink-receiving layer of the first aspect, the saponification degree of the PVA may be preferably less than 90 mol % in view of suppression of curing and improvement of density of recorded image (such as the maximum density (Dm)) of the recording medium.

In embodiments of the ink-receiving layer of the first aspect, the polymerization degree of the PVA may be preferably from 1400 to 5000, and more preferably from 2300 to 4000, in view of providing sufficient film strength to the recording medium.

In view of suppressing deterioration of film strength and generation of cracking under dried conditions which may be caused by insufficient content of the water-soluble resin, and in view of suppressing deterioration of ink absorption property caused by decrease of the void volume ratio due to clogging of the voids by the water-soluble resin which may be caused by excessive content of the water-soluble resin, the content of the water-soluble resin may be preferably from 9% by mass to 40% by mass, and more preferably from 12% by mass to 25% by mass, with respect to the total solid content of the ink-receiving layer.

Specifically, in the ink-receiving layer of the first aspect, the content of the PVA as the water-soluble resin may be preferably from 5% by mass to 30% by mass, and more preferably from 10% by mass to 20% by mass, with respect to the total solid content of the ink-receiving layer.

The PVA has a hydroxyl group in its structural units. Since this hydroxyl group forms a hydrogen bond with a silanol group on the surface of the fumed silica, a three-dimensional network structure having the secondary particles of the silica particles as a network chain unit can be easily formed. It is assumed that the formation of such a three-dimensional network structure makes it possible to form an ink-receiving layer having a porous structure with a high porosity and sufficient strength. The ink-receiving layer having the porous structure as described above may absorb ink quickly by a capillary phenomenon, and may form good dots in substantially perfect circles without ink bleeding.

The ink-receiving layer is mainly formed of the inorganic fine particles and a water-soluble resin. The inorganic fine particles and the water-soluble resin may be respectively formed of a single material or a combination of plural materials.

Particularly, in the first aspect, if the water-soluble resin in the ink-receiving layer has a combination of PVA with other water-soluble resins as its components, the amount of PVA with respect to the total mass of the water-soluble resin may be preferably 50% by mass or more, and more preferably 70% by mass or more.

Content Ratio of Inorganic Fine Particles to Water-Soluble Resin

The film structure of the ink-receiving layer may depend on the content ratio of the inorganic fine particles (x) to the water-soluble resin (y) (PB ratio (x/y), that is the part by mass of the inorganic fine particles with respect to 1 part by mass of the water-soluble resin). In general, as the PB ratio increases, the void volume ratio, pore volume and surface area (per unit mass) of the ink-receiving layer also increase. In view of suppressing deterioration of film strength and generation of cracking under dried conditions which may be caused by excessively large PB ratio, and in view of suppressing deterioration of ink absorption property caused by decrease of the void volume ratio due to clogging of the voids by the water-soluble resin which may be caused by excessively small PB ratio, the PB ratio may be preferably from 1.5/1 to 10/1.

The ink-receiving layer may be required to have sufficiently high film strength. This is because a stress may be applied thereto during transfer of the inkjet recording medium through a conveying system, and because cracking, peeling, and the like of the ink-receiving layer may occur when the inkjet-recording medium is cut into sheets. Considering these, the PB ratio (x/y) is preferably 8/1 or less. From the viewpoint of ensuring high-speed ink absorbability when the inkjet-recording medium is used in inkjet printers, the ratio may be preferably 2/1 or more. Specifically in the first aspect, the PB ratio (x/y) of the ink-receiving layer may be preferably 6/1 or less but 3/1 or more.

For example, in the case where fumed silica fine particles with an average primary particle diameter of 20 nm or less and a water-soluble resin are homogeneously dispersed in an aqueous solution at the PB ratio (x/y) of 2/1 to 8/1 to prepare a coating liquid, and the coating liquid is coated on a support, followed by drying, a three-dimensional network structure having, as the network (chain) structure unit, secondary particles of the silica fine particles is formed. Thus, there can be easily formed a translucent porous film with an average pore diameter of 30 nm or less, void volume ratio of from 50% to 80%, specific pore volume of 0.5 mL/g or more, and specific surface area of 100 $m^2/g$ or larger.

Basic Compound

In embodiments, the ink-receiving layer preferably contains at least one basic compound from the viewpoint of the density of the formed image. The basic compound is not particularly limited, and examples thereof include ammonia (including an ammonium salt), hydroxides of an alkaline metal or alkali earth metal, and amino group-containing compounds (for example, ethylamine, ethanol amine, diethanol amine, and polyallylamine). Among these, from the viewpoint of the image density, an ammonium salt of an inorganic acid or organic acid may be preferable, an ammonium salt of an organic acid, ammonium carbonate, or ammonium chloride may be more preferable, and ammonium carbonate or ammonium chloride may be further preferable.

The ratio of the content of the basic compound in the ink-receiving layer may be, for example, from 0.1% by mass to 5% by mass, and it may be preferably from 0.1% by mass to 2.5% by mass, with respect to the total solid content of the ink-receiving layer from the viewpoint of the image density.

In embodiments, the basic compound may be preferably contained in at least a basic solution applied to the ink-receiving layer formed by coating a coating liquid for forming the ink-receiving layer. The reason for this is that the incorporation of the basic compound in the coating liquid for forming the ink-receiving layer may facilitate to thicken the coating liquid for forming the ink-receiving layer according to the kind of the basic compound.

Crosslinking Agent

In embodiments, the ink-receiving layer may contain a crosslinking agent which can crosslink the water-soluble resin.

Any crosslinking agent which is suitable in view of compatibility with the water-soluble resin in the ink-receiving layer may be used. In embodiments, a boron compound may be preferably used for progressing rapid crosslinking reaction. Examples of the borate compound include borax, boric acid, borate salts [e.g., orthoborate salts, $InBO_3$, $ScBO_3$, $YBO_3$, $LaBO_3$, $Mg_3(BO_3)_2$, and $Co_3(BO_3)_2$], diborate salts [e.g., $Mg_2B_2O_5$], metaborate salts [e.g., $LiBO_2$, $Ca(BO_2)_2$, $NaBO_2$, and $KBO_2$], tetraborate salts [e.g., $Na_2B_4O_7.10H_2O$], and pentaborate salts [e.g., $KB_5O_8.4H_2O$, $Ca_2B_6O_{11}.7H_2O$, and $CsB_5O_5$]. Among them, borax, boric acid and borates may be preferable, and boric acid may be more preferable for further progressing rapid crosslinking reaction. In embodiments, any one of these crosslinking agents may be further preferably used in combination with the PVA which is used as the water-soluble resin.

In embodiments, the content of boric acid may be preferably 0.05 parts by mass to 0. 50 parts by mass, and more preferably 0.08 parts by mass to 0.30 parts by mass, with respect to 1.0 part by mass of the water-soluble resin contained in the ink-receiving layer in view of effectively crosslink the water-soluble resin and effectively suppressing disorders such as cracking.

The crosslinking agent may be used singly or in combination of two or more thereof In the case of using a water-soluble resin other than PVA is also used in combination with PVA (such as gelatins), the crosslinking agent may be a compound other than the boron compound. Examples of such other crosslinking agent include aldehyde compounds such as formaldehyde, glyoxal, and glutaraldehyde; ketone compounds such as diacetyl and cyclopentanedione; active halide compounds such as bis(2-chloroethylurea)-2-hydroxy-4,6-dichloro-1,3,5-triazine and sodium salts of 2,4-dichloro-6-S-triazine; active vinyl compounds such as divinylsulfonic acid, 1,3-vinylsulfonyl-2-propanol, N,N'-ethylene bis(vinylsulfonylacetamide), and 1,3,5-triacryloyl-hexahydro-S-triazine; N-methylol compounds such as dimethylolurea and methyloldimethylhydantoin; melamine resins such as methylolmelamine and alkylated methylolmelamines; epoxy resins;

isocyanate compounds such as 1,6-hexamethylene diisocyanate; aziridine compounds described in U.S. Pat. No. 3,017,280 and U.S. Pat. No. 2,983,611; carboxyimide compounds described in U.S. Pat. No. 3,100,704; epoxy compounds such as glycerol triglycidyl ether; ethyleneimino compounds such as 1,6-hexamethylene-N,N'-bisethyleneurea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chromium alum, potash alum, zirconyl acetate, and chromium acetate; polyamine compounds such as tetraethylenepentamine; hydrazide compounds such as adipic acid dihydrazide; and low-molecular compounds and polymers having 2 or more oxazoline groups. The crosslinking agents may be used singly or in combination of two or more.

In embodiments, the crosslinking agent may be added to the coating liquid for forming the ink-receiving layer and/or a coating liquid for forming a layer which is adjacent to the ink-receiving layer, when the ink-receiving layer is formed. In other embodiments, the coating liquid for forming the ink-receiving layer may be applied on a support to which the coating liquid containing the crosslinking agent is preliminarily applied. In still other embodiments, a liquid containing the crosslinking agent may be supplied to the ink-receiving layer by applying and drying the coating liquid for forming the ink-receiving layer containing no crosslinking agent and then coating the crosslinking agent-containing liquid thereover. In embodiments, from the viewpoint of production efficiency, it may be preferable to supply the crosslinking agent simultaneously with the formation of the ink-receiving layer by adding the crosslinking agent to the coating liquid for forming the ink-receiving layer or the coating liquid forming a layer which is adjacent to the ink-receiving layer. Particularly, from the viewpoint of an improvement in the density and glossiness of the image, it may be preferable to add the crosslinking agent to the coating liquid for forming the ink-receiving layer.

In the first aspect, the concentration of the crosslinking agent in the ink-receiving layer may be preferably from 0.05 to 10% by mass, and more preferably from 0.1 to 7% by mass, with respect to the total solid content of the layer.

In the second aspect, the concentration of the crosslinking agent in the coating liquid for forming the ink-receiving layer may be preferably from 0.05% by mass to 5% by mass, and more preferably from 0.1% by mass to 1% by mass.

Mordant

In embodiments, the ink-receiving layer may contain a mordant in view of improving water resistance and bleeding resistance over time of the image formed on the ink-receiving layer. Examples of the mordant include organic mordants such as a cationic resin polymer (cationic mordant). Among these, from the viewpoint of suppressing bleeding and the density of printed images, the cation-modified self-emulsifiable polymers described below may be preferable. Examples of the mordant further include a cationic non-polymer mordant.

Specific examples of the mordant include polymer mordants obtained as a homopolymer of a monomer (mordant monomer) having a secondary amino group, a tertiary amino group, a salt of any one of these, or a quaternary ammonium salt group; or polymer mordants obtained as a copolymer or a condensed polymer of any one or more of these mordant monomers and other one or more monomers (non-mordant monomers). Examples of the mordant monomers for forming a polymer mordant and the non-mordant monomers include those described in paragraphs [0044] to [0051] of JP-A No. 2005-81645, and the compounds described in paragraphs [0082] to [0089] of JP-A No. 2006-15655, and also include the polymer mordants described in paragraphs [0052] to [0053] of JP-A No. 2005-81645.

These polymer mordants may be in the form either of a water-soluble polymer or a water-dispersible latex particle.

Examples of the polymer mordant further include polydiallyldimethylammonium chloride, polymethacryloyloxyethyl-β-hydroxyethyldimethylammonium chloride, polyethyleneimine, polyallylamine and a modified product thereof, polyallylamine hydrochloride, a polyamide-polyamine resin, cationized starch, a dicyandiamide-formalin condensate, a dimethyl-2-hydroxypropyl ammonium salt polymer, polyamidine, polyvinyl amine, a cationized acrylic emulsion of an acrylic silicon latex described in JP-A Nos. 10-264511, 2000-43409, 2000-343811, and 2002-120452 (namely, trade names: AQUABRID Series ASi-781, ASi-784, ASi-578, and ASi-903, manufactured by Daicel Chemical Industries, Ltd.), and cationic modified self-emulsifiable polymers (preferably cationic modified polyurethane such as a cation-modified self-emulsifiable polymer described in paragraphs [0021] to [0049] of JP-A No. 2006-15655).

The molecular weight of the polymer mordant may be preferably from 2,000 to 300,000 in terms of a weight-average molecular weight. When the molecular weight is within this range, the water resistance and the bleeding resistance over time may be further improved.

Among those, a polyallylamine or a derivative thereof may be preferable as the polymer mordant. In embodiments, from the viewpoint of suppressing the color change of images after printing, a polyallylamine or a derivative thereof having a weight-average molecular weight of 100,000 or less may be preferable. Examples of the polyallylamine and a derivative thereof include various known allylamine polymers and derivatives thereof Examples of the derivatives include salts formed from the polyallylamine and an acid (examples of the acid include inorganic acids such as hydrochloric acid, sulfuric acid, phosphoric acid, and nitric acid, organic acids such as methanesulfonic acid, toluenesulfonic acid, acetic acid, propionic acid, cinnamic acid, and (meth)acrylic acid, a combination thereof, and those in which a part of the allylamine is converted into a salt), a derivative of a polyallylamine obtained by a polymeric reaction, a copolymer of a polyallylamine with other copolymerizable monomers (specific examples of the monomers include (meth)acrylic acid esters, styrenes, (meth)acrylamides, acrylonitrile, and vinyl esters).

Specific examples of the polyallylamine and a derivative thereof include the compounds described in paragraph [0056] of JP-A No. 2005-81645.

In embodiments, the cationic resin may be preferably a polydiallylamine derivative, more preferably a polydiallyldimethylammonium salt (examples of the counter anion of the salt include a chloride ion, an acetic acid ion, and a sulfuric acid ion), and even more preferably polydiallyldimethylammonium chloride.

The molecular weight of the cationic resin may be preferably in the range of from 2,000 to 100,000 in terms of the weight-average molecular weight. When the molecular weight is 2,000 or more, the viscosity stability of a silica dispersion or a coating liquid for forming the ink-receiving layer upon preparation may be improved, and drastic increase in the liquid viscosity may be suppressed, whereas when the molecular weight is 100,000 or less, increase of the viscosity of the liquid may be suppressed, the viscosity stability of the coating liquid for forming the ink-receiving layer may be improved, and drastic increase in the coating liquid viscosity may be suppressed.

Here, the liquid viscosity of the silica dispersion or the coating liquid for forming the ink-receiving layer can be measured using a commercially available viscometer such as a B type viscometer.

The content of the cationic resin in the ink-receiving layer may be preferably in the range of from 0.5% by mass to 10% by mass in the fumed silica, and more preferably in the range of from 2.0% by mass to 6.0% by mass. If the content of the cationic resin is 2.0% by mass or more, the viscosity stability of the silica dispersion may be improved, whereas if the content of the cationic resin is 6.0% by mass or less, decrease in the void volume of the ink-receiving layer may be suppressed.

The void volume of the ink-receiving layer may be measured by a commercially-available mercury porosimeter (for example, trade name: "PORESIZER 9320-PC2", manufactured by Shimadzu Corporation).

Cation-Modified Self-Emulsifiable Polymer

The "cation-modified self-emulsifiable polymer" means a polymer compound that can become a naturally stable emulsified dispersion in an aqueous dispersion medium without using an emulsifier or a surfactant or with addition of a very small amount thereof Quantitatively, the "cation-modified self-emulsifiable polymer" represents a polymer substance that has a stable emulsification and dispersion ability at a concentration equal to or higher than 0.5% by mass in an aqueous dispersion medium at a room temperature of 25° C., and this concentration is preferably equal to or higher than 1% by mass and even more preferably equal to or higher than 3% by mass.

More specific examples of the cation-modified self-emulsifiable polymer include a polyaddition polymer compound or a polycondensation polymer compound having a cationic group such as a primary to tertiary amino group or a quaternary ammonium group.

Examples of vinyl polymerization polymers useful for forming the cation-modified self-emulsifiable polymer include polymers obtained by polymerizing the following vinyl monomers. Examples of such vinyl monomers include acrylic acid esters or methacrylic acid esters in which the ester group may optionally have an alkyl group or an aryl group as a substitutent, example of the substituent including a methyl group, an ethyl group, an n-propyl group, an isopropyl group, an n-butyl group, a sec-butyl group, a tert-butyl group, a hexyl group, a 2-ethylhexyl group, a tert-octyl group, a 2-chloroethyl group, a cyanoethyl group, a 2-acetoxyethyl group, a tetrahydrofurfuryl group, a 5-hydroxypentyl group, a cyclohexyl group, a benzyl group, a hydroxyethyl group, a 3-methoxybutyl group, a 2-(2-methoxyethoxy)ethyl group, a 2,2,2-trifluoroethyl group, a 1,2,2,2-tetrafluoroethyl group, a 1H,1H,2H,2H-perfluorodecyl group, a phenyl group, a 2,4,5-trimethylphenyl group, a 2,3,4,5-tetramethylphenyl group, a 2,4,5,6-tetramethylphenyl group, or a 4-chlorophenyl group;

vinyl esters, more specifically, optionally substituted aliphatic carboxylic acid vinyl esters (for example, vinyl acetate, vinyl propionate, vinyl butyrate, vinyl isobutyrate, vinyl caproate, and vinyl chloroacetate), optionally substituted aromatic carboxylic acid vinyl esters (for example, vinyl benzoate, vinyl 4-methyl benzoate, and vinyl salicylate);

acrylamides, more specifically, acrylamide, N-monosubstituted acrylamide, and N-disubstituted acrylamide, in which the substituent is an alkyl group, an aryl group, or a silyl group, each of which being optionally substituted and examples of which including a methyl group, an n-propyl group, an isopropyl group, an n-butyl group, a tert-butyl group, a tert-octyl group, a cyclohexyl group, a benzyl group, a hydroxymethyl group, an alkoxymethyl group, a phenyl group, a 2,4,5-trimethylphenyl group, a 2,3,4,5-tetramethylphenyl group, a 2,4,5,6-tetramethylphenyl group, a 4-chlorophenyl group, and trimethylsilyl group;

methacrylamides, more specifically, methacrylamide, N-monosubstituted methacrylamide, and N-disubstituted methacrylamide, in which the substituent is an alkyl group, an aryl group, or a silyl group, each of which being optionally substituted and examples of which including a methyl group, an n-propyl group, an isopropyl group, an n-butyl group, a tert-butyl group, a tert-octyl group, a cyclohexyl group, a benzyl group, a hydroxymethyl group, an alkoxymethyl group, a phenyl group, a 2,4,5-trimethylphenyl group, a 2,3,4,5-tetramethylphenyl group, a 2,4,5,6-tetramethylphenyl group, a 4-chlorophenyl group, and trimethylsilyl group;

olefins (for example, ethylene, propylene, 1-pentene, vinyl chloride, vinylidene chloride, isoprene, chloroprene, and butadiene);

styrenes (for example, styrene, methylstyrene, isopropylstyrene, methoxystyrene, acetoxystyrene, and chlorostyrene); and vinyl ethers (for example, methyl vinyl ether, butyl vinyl ether, hexyl vinyl ether, and methoxyethyl vinyl ether).

Examples of the vinyl monomers further include crotonic acid esters, itaconic acid esters, maleic acid diesters, fumaric acid diesters, methyl vinyl ketone, phenyl vinyl ketone, methoxyethyl vinyl ketone, N-vinyl oxazolidone, N-vinyl pyrrolidone, methylene malononitrile, diphenyl-2-acryloyl oxyethyl phosphate, diphenyl-2-methacryloyl oxyethyl phosphate, dibutyl-2-acryloyl oxyethyl phosphate, and dioctyl-2-methacryloyl oxyethyl phosphate.

Examples of the monomer having a cationic group include monomers having a tertiary amino group, such as dialkylaminoethyl methacrylates and dialkylaminoethyl acrylates.

Examples of polyurethane which can be used for forming the cation-modified self-emulsifiable polymer include polyurethanes synthesized, for example, by performing polyaddition reaction of the following diol compounds and diisocyanate compounds in various combination.

Specific examples of diol compounds include ethylene glycol, 1,2-propanediol, 1,3-propanediol, 1,2-butanediol, 1,3-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol, polyethylene glycol (average molecular weight is equal to 200, 300, 400, 600, 1000, 1500, 4000), polypropylene glycol (average molecular weight is equal to 200, 400, 1000), polyesterpolyols, 4,4'-dihydroxydiphenyl-2,2-propane, and 4,4'-dihydroxyphenylsulfone.

Examples of diisocyanate compounds include methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-naphthalene diisocyanate, m-phenylene diisocyanate, p-phenylene diisocyanate, 3,3'-dimethyl-4,4'-diphenylmethane diisocyanate, 3,3'-dimethylbiphenylene diisocyanate, 4,4'-biphenylene diisocyanate, dicyclohexylmethane diisocyanate, and methylenebis (4-cyclohexylisocyanate).

Examples of a cationic group contained in the cationic group-containing polyurethane include primary to tertiary amines and quaternary ammonium salts. In embodiments, the cation-modified self-emulsifiable polymer may be preferably a cationic polyurethane having a cationic group such as tertiary amine and a quaternary ammonium salt.

The cationic group-containing polyurethane can be obtained, for example, by using a compound obtained by introducing a cationic group into a diol such as described hereinabove when the polyurethane is synthesized. In the case of a cation-modified self-emulsifiable polymer having a quaternary ammonium salt as the cationic group is to be prepared, a polyurethane having a tertiary amine group may be quaternized with a quaternizing agent.

The diol compound and the diisocyanate compound used for the synthesis of the polyester may be used by one compound of each kind, or two or more compounds of each kind may be used in combination at arbitrary ratios according to the desired objects (such as adjustment of glass transition temperature (Tg) or solubility of the polymer, improvement of mutual solubility with the dye, and stabilization of dispersion).

Examples of polyesters which can be used for forming the polymer having a cationic group include polyesters synthesized by a polycondensation reaction of a variety of combinations of the diol compounds and dicarboxylic acid compound described below.

Examples of the dicarboxylic acid compounds include oxalic acid, malonic acid, succinic acid, glutalic acid, dimethylmalonic acid, adipic acid, pimelic acid, α,α-dimethylsuccinic acid, acetonedicarboxylic acid, sebacic acid, 1,9-nonanedicarboxylic acid, fumaric acid, maleic acid, itaconic acid, citraconic acid, phthalic acid, isophthalic acid, terephthalic acid, 2-butylterephthalic acid, tetrachloroterephthalic acid, acetylenedicarboxylic acid, poly(ethylene terephthalate)dicarboxylic acid, 1,2-cyclohexanedicarboxylic acid, 1,4-cyclohexanedicarboxylic acid, ω-poly(ethylene oxide) dicarboxylic acid, and p-xylylenedicarboxylic acid.

When a polycondensation reaction of the dicarboxylic acid compound and a diol compound is performed, the dicarboxylic acid compound for use in the reaction may be in the form of a dicarboxylic acid alkyl ester (such as a dimethyl ester), in the form of a chloride salt of dicarboxylate, or may be in the form of a dicarboxylic acid anhydride such as malic anhydride, succinic anhydride, or phthalic anhydride.

Compounds similar to the diols exemplified for the polyurethane can be also used as the diol compounds.

The polyester having a cationic group may be obtained by synthesis using a dicarboxylic acid compound having a cationic group such as a primary, secondary, tertiary, or quaternary ammonium salt.

The diol compound and the dicarboxylic acids used for the synthesis of the polyester may be used by one compound of each kind, or two or more compounds of each kind may be used in combination at arbitrary ratios according to the desired objects (such as adjustment of glass transition temperature (Tg) or solubility of the polymer, improvement of mutual solubility with the dye, and stabilization of dispersion).

The content of cationic groups in the cationic group-containing polymer is preferably from 0.1 mmol/g. to 5 mmol/g, and more preferably 0.2 mmol/g. to 3 mmol/g. When the content of cationic groups is too small, the dispersion stability of the polymer may be decreased, and when the content of cationic groups is too much, mutual solubility of the cationic group-containing polymer with the binder can be decreased.

In embodiments, the cation-modified self-emulsifiable polymer may be preferably a cationic group-containing polymer having a tertiary amine group or a quaternary ammonium basic group, and may be more preferably the cationic group-containing polyurethane.

A glass transition temperature of the self-emulsifiable polymer may be taken into consideration when it is used in the ink-receiving layer.

In embodiments, in view of suppressing image bleeding with time over a long period after the image has been formed by inkjet recording and improving dimensional stability (resistance to curling), it may be preferable that the glass transition temperature of the self-emulsifiable polymer is less than 50° C., more preerably equal to or less than 30° C., and still more preferably equal to or less than 15° C. The lower limit of the glass transition temperature is not particularly limited. In embodiments, from the standpoint of suitability for production during preparation of an aqueous dispersion, the glass transition temperature may be about −30° C. in usual applications.

Usually, the weight-average molecular weight (Mw) of the self-emulsifiable polymer may be preferably from 1000 to 200,000, and more preferably from 2000 to 50,000. When the molecular weight is equal to or higher than 1000, a more stable aqueous dispersion can be obtained. Furthermore, when the molecular weight is equal to or less than 200,000, solubility can be further increased, liquid viscosity can be further decreased, and an average particle size of aqueous dispersion can be further decreased (for example, regulated to a value equal to or less than 0.05 μm).

When the ink-receiving layer contains the self-emulsifiable polymer, the content of the self-emulsifiable polymer may be preferably from 0.1% by mass to 30% by mass, more preferably from 0.3% by mass to 20% by mass, and further preferably from 0.5% by mass to 15% by mass, based on the total solid content of the ink-receiving layer. When this content is equal to or higher than 0.1% by mass, the improvement of bleeding with time may be obtained. When the content is equal to or less than 30% by mass, the ratio of the content of fine particles to the content of binder component may be maintained to provide favorable ink absorption property.

A method for preparing an aqueous dispersion of the self-emulsifiable polymer will be described below.

An aqueous dispersion with an average particle size of equal to or less than 0.05 μm may be obtained by mixing the self-emulsifiable polymer with an aqueous solvent, if necessary, also with additives to prepare a mixture, and finely dispersing the mixture by using a disperser. A variety of known conventional dispersers such as a high-speed rotary disperser, a medium-stirring disperser (a ball mill, a sand mill, a beads mill, and the like), an ultrasonic disperser, a colloid mill disperser, and a high-pressure disperser may be used as the disperser for obtaining the aqueous dispersion. From the standpoint of efficiently dispersing the obtained ball-shaped fine particles, the medium-stirring disperser, colloid mill disperser, and a high-pressure disperser may be preferable.

A detailed structure of the high-speed disperser (homogenizer) is described in U.S. Pat. No. 4,533,254 and JP-A No. 6-47264. Examples of suitable commercial products include a GAULIN HOMOGENIZER (trade name, manufactured by A. P. V. Gaulin Inc.), MICROFLUIDIZER (trade name, manufactured by Microfluidex Inc.), and ULTIMIZER (trade name, manufactured by Sugino Machine KK). A high-pressure homogenizer equipped with a mechanism for atomization in an ultrahigh-pressure jet flow, such as described in U.S. Pat. No. 5,720,551 may be especially effective for emulsifying and dispersing. DeBEE 2000 (BEE International Ltd.) is an example of an emulsification device using such an ultrahigh-pressure jet flow.

Water, organic solvents, or mixed solvents thereof may be used as the aqueous medium in the dispersing process. Examples of organic solvents that can be used for such dispersing include alcohols such as methanol, ethanol, n-propanol, i-propanol, and methoxypropanol, ketones such as acetone and methyl ethyl ketone, and also tetrahydrofuran, acetonitrile, ethyl acetate, and toluene.

The self-emulsifiable polymer itself may produce a naturally stable emulsified dispersion. In embodiments, a small amount of a dispersant (surfactant) may be also used to accelerate the emulsification and dispersion of the self-emulsifiable polymer and further improve stability of the thus-formed dispersion. Examples of the surfactant that can be used for such a purpose include anionic surfactants such as fatty acid salts, alkylsulfonic acid esters, alkylbenzenesulfonates, alkylnaphthalenesulfonates, diakylsulfosuccinates, alkylphosphoric acid esters, napthalenesulfonic acid formalin condensate, and polyoxyethylene alkylsulfonic acid esters, and nonionic surfactants such as polyoxyethylene alkyl ethers, polyoxyethylene alkyl allyl ethers, polyoxyethylene fatty acid esters, sorbitan fatty acid esters, polyoxyethylene sorbitan fatty acid esters, polyoxyethylene alkylamines, glycerin fatty acid esters, and oxyethylene oxypropylene block copolymers. SURFYNOLS (trade name, manufactured by Air Products & Chemical Co., Ltd.), which is acetylene-containing polyoxyethylene oxide surfactants, can be also advantageously used. Amineoxide amphoteric surfactants such as N,N-dimethyl-N-alkylamine oxide are also preferred. Compounds described as surfactants in JP-A No. 59-157,636 (pages 37-38) and Research Disclosure No. 308119 (1989) can be also used.

In embodiments, a water-soluble polymer can be added together with the surfactant in view of stabilizing the dispersion immediately after emulsification. Preferable examples of the water-soluble polymer include poly(vinyl alcohol), poly(vinyl pyrrolidone), polyethylene oxide, polyacrylic acid, polyacrylamides, and copolymers thereof. Natural water-soluble polymers such as polysaccharides, casein, and gelatin can be also preferably used.

When the self-emulsifiable polymer is dispersed in an aqueous dispersion medium by the emulsification dispersing method, the particle size may be preferably regulated. In view of improving color purity and color density when an image is formed with an inkjet, an average particle size of the self-emulsifiable polymer in the aqueous dispersion may be reduced. In embodiments, the volume-average particle size of the self-emulsifiable polymer in the ink-receiving layer may be preferably equal to or less than 0.05 μm, more preferably equal to or less than 0.04 μm, and even more preferably equal to or less than 0.03 μm.

Water-Soluble Polyvalent Metal Salt

In embodiments, a water-soluble polyvalent metal salt may be contained in the ink-receiving layer. When the water-soluble polyvalent metal salt is contained in the ink-receiving layer, the dispersing property of the inorganic fine particles may be improved.

Examples of the water-soluble polyvalent metal salt include water-soluble salts of one or more metals selected from calcium, barium, manganese, copper, cobalt, nickel, aluminum, iron, zinc, zirconium, chromium, magnesium, tungsten, and molybdenum. Specific examples thereof include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminum sulfate, aluminum sulfite, aluminum thiosulfate, poly aluminum chloride, aluminum nitrate nonahydrate, aluminum chloride hexahydrate, iron (II) bromide, iron (II) chloride, iron (III) chloride, iron (II) sulfate, iron (III) sulfate, zinc bromide, zinc chloride, zinc nitrate hexahydrate, zinc sulfate, zirconium acetate, zirconium chloride, zirconium chloride oxide octahydrate, zirconium hydroxychloride, chromium acetate, chromium sulfate, magnesium sulfate, magnesium chloride hexahydrate, magnesium citrate nonahydrate, sodium phosphotungstate, sodium tungsten citrate, 12-tungstophosphoric acid n-hydrate, 12-tungstosilicic acid 26-hydrate, molybdenum chloride, and 12-molybdophosphoric acid n-hydrate. These water-soluble polyvalent metal salts may be used singly or in combinations of two or more thereof.

Among these water-soluble polyvalent metal salts, a water-soluble salt of aluminum, a water-soluble salt of zirconium and/or a water-soluble salt of titanium may be preferable. Examples of the water-soluble aluminum salt include inorganic salts such as aluminum chloride or hydrates thereof, aluminum sulfate or hydrates thereof, and ammonium alum. Examples of the water-soluble aluminum salt further include a basic aluminum polyhydroxide aluminum compound, which is an inorganic aluminum-containing cation polymer. In embodiments, a basic aluminum polyhydroxide aluminum compound may be preferable.

The basic aluminum polyhydroxide compound is a basic water-soluble aluminum polyhydroxide having a main component represented by any one of the following Formula 1, 2, or 3 and stably including a high-molecular polynuclear condensation ion such as $[Al_6(OH)_{15}]^{3+}$, $[Al_8(OH)_{20}]^{4+}$, $[Al_{13}(OH)_{34}]^{5+}$, or $[Al_{21}(OH)_{60}]^{3+}$.

$$[Al_2(OH)_nCl_{6-n}]_m \quad \text{Formula 1:}$$

$$[Al(OH)_3]_nAlCl_3 \quad \text{Formula 2:}$$

$$Al_n(OH)_mCl_{(3n-m)}\ (0<m<3n) \quad \text{Formula 3:}$$

There is no particular limitation to the water-soluble salt of zirconium. Specific examples of the water-soluble salt of zirconium include zirconium acetate, zirconium chloride, zirconium chloride oxide, zirconium hydroxychloride, zirconium nitrate, basic zirconium carbonate, zirconium hydroxide, zirconium ammonium carbonate, zirconium potassium carbonate, zirconium sulfate, and fluorinated zirconium compounds.

There is no particular limitation to the water-soluble salt of titanium. Specific examples of the water-soluble salt of titanium include titanium chloride and titanium sulfate.

These compounds are commercially available as a water-treatment agent. Examples of such water-treatment agent include POLY(ALUMINUM CHLORIDE) (PAC) (trade name, available from Taki Kagaku Co., Ltd.), POLY(ALUMINUM HYDROXIDE) (PAHO) (trade name, available from Asada Kagaku KK), and PURACHEM WT (trade name, available from Riken Green KK). Such compounds are also produced by other manufacturers with a similar object, and various grades agents thereof are readily available. There are some commercial product of the water-treatment agent which have unsuitably low pH. pH of such water-treatment agent products having low pH may be appropriately adjusted when they are used.

The "water-soluble" herein means a property of a material which can be dissolved in water at a concentration of 1% by mass or more under ordinary temperature and ordinary pressure.

In embodiments, the water-soluble polyvalent metal salt employed in the first aspect may be preferably a water-soluble salt of zirconium in terms of the viscosity of the coating liquid for forming the ink-receiving layer, and may be preferably a weakly acidic water-soluble salt of zirconium and more preferably zirconyl acetate in terms of the viscosity stability of the coating liquid.

In preferable embodiments, when zirconyl acetate is used, zirconyl acetate may be incorporated into a dispersion of the fumed silica in advance, and the dispersion may be then mixed with PVA, in view of assuring the viscosity stability of the coating liquid, and in preferable embodiments, zirconyl acetate may be allowed to coexist in a solution containing the fumed silica prior to dispersing the fumed silica in the solution, and then performing dispersing to provide the dispersion of the fumed silica.

The content of the water-soluble polyvalent metal salt in the ink-receiving layer in the first aspect may be preferably from 0.5% by mass to 10% by mass, and more preferably from 1.0% by mass to 5.0% by mass, in the fumed silica. When the content is 0.5% by mass or more, the viscosity stability of the silica dispersion may be improved, whereas when the content is 10% by mass or less, cracks may not be easily generated on the ink-receiving layer surface.

The ink-receiving layer in the second aspect contains at least one chloride ion-containing zirconium salt. If a zirconium compound other than the chloride ion-containing zirconium salt is used in the second aspect, there are cases where suppression of the offensive odor of the ink-receiving layer and suppression of bronzing cannot be sufficiently satisfied simultaneously. For example, if zirconyl acetate is used as a zirconium compound, there are cases where the offensive odor of the ink-receiving layer cannot be suppressed. Further, if zirconyl nitrate, zirconyl sulfate, or the like is used, the viscosity of the coating liquid for forming the ink-receiving layer may be likely to rise, and thus there are cases where it is difficult to add a desired content. As a result, there are cases where sufficient suppression of bronzing cannot be accomplished.

The ink-receiving layer in the second aspect contains at least one water-soluble salt of aluminum. Details and suitable examples of the water-soluble aluminum salt are as described above.

In embodiments, in the second aspect, the content ratio of the water-soluble aluminum salt in the ink-receiving layer may be preferably from 0.1% by mass to 10% by mass, and more preferably from 1% by mass to 5% by mass, with respect to 100% by mass of the inorganic fine particles described below, from the viewpoint of ozone resistance. Namely, the mass ratio of the content of the water-soluble aluminum salt to the content of the inorganic fine particles (water-soluble aluminum salt/inorganic fine particles) may be preferably from 0.001 to 0.1, and more preferably from 0.01 to 0.05.

Other Components

The ink-receiving layer may further contain, as additional components, various components such as a mordant, a surfactant, various ultraviolet absorbents, an antioxidant, an anti-fading agent such as a singlet oxygen quencher, a high-boiling temperature organic solvent, a pH adjusting agent, a dispersant, an antifoaming agent, and an antistatic agent. The ink-receiving layer may further contain metal oxide fine particles having electrical conductivity in view of suppressing static electricity caused by friction or separation on the surface, and may contain various kinds of matting agents in view of reducing the friction properties of the surface.

As the other components, components described in paragraphs [0088] to [0117] of JP-A No. 2005-14593, the components described in paragraphs [0138] to [0155] of JP-A No. 2006-321176 and/or the like may be suitably selected and used.

Method for Producing Inkjet Recording Medium

The inkjet recording medium may be produced by any methods as long as it provides the ink-receiving layer onto a support. Examples of such methods include a method including applying a coating liquid for forming the ink-receiving layer onto a support and drying the coated liquid.

Examples of a method for forming the inkjet recording medium of one exemplary embodiment of the first aspect include a method including at least: adding the hydroxycarboxylic acid ester having an I/O value of 1.5 or more as determined in accordance with an organic conceptual diagram and the polyvinyl alcohol to a silica dispersion comprising the fumed silica to prepare a coating liquid in which the amount of the hydroxycarboxylic acid ester is from 0.1 moles to 2 moles with respect to 1 kg of the fumed silica; and applying the coating liquid to a support to form an ink-receiving layer.

In embodiments, preparation of the coating liquid in a method for producing the inkjet recording medium of the first aspect may include preliminarily preparing a silica dispersion containing the fumed silica, and adding a hydroxycarboxylic acid ester and a polyvinyl alcohol to this silica dispersion to prepare a coating liquid for forming the ink-receiving layer, in which the amount of the hydroxycarboxylic acid ester is from 0.1 moles to 2 moles with respect to 1 kg of the fumed silica.

The coating liquid for forming the ink-receiving layer which is used to form the ink-receiving layer in the first aspect can be prepared, for example, in the following manner.

First, the fumed silica (preferably one having an average primary particle diameter of 15 nm or less), diallydimethylammonium chloride, and a water-soluble polyvalent metal salt are added into water, and pre-dispersed using a dissolver or a suction disperser, for example, under a high speed rotation condition of a rotation number of 3,000 rpm (preferably from 500 rpm to 4,000 rpm) for 20 minutes (preferably for 10 minutes to 30 minutes). Thereafter, the resultant is finely dispersed using a desired disperser, whereby a silica dispersion can be prepared.

Then, a boron compound (for example, 0.5% by mass to 20% by mass with respect to the fumed silica) and a hydroxycarboxylic acid ester are added to the prepared silica dispersion, followed by addition of an aqueous polyvinyl alcohol solution (for example, PVA added to about ⅕ by mass of the fumed silica), and stirring under a high speed rotation condition of, for example, a rotation number of 2,000 rpm (preferably from 1,000 rpm to 3,000 rpm) for 10 minutes (preferably for 10 minutes to 30 minutes) using, for example, a dissolver, whereby the coating liquid can be prepared.

The obtained coating liquid is a uniform sol, and by applying this on a support by a desired application method, an ink-receiving layer with a porous structure having a three-dimensional network structure can be obtained.

The ink-receiving layer in the recording medium for inkjet recording of one exemplary embodiment of the second aspect can be formed, for example, by a method including preparing a coating liquid containing at least the chloride ion-containing zirconium salt, the water-soluble aluminum salt, the hydroxy acid derivative, the inorganic fine particles, and the water-soluble resin, and applying the prepared coating liquid onto a support to form the ink-receiving layer.

This configuration of the coating liquid for forming the ink-receiving layer may facilitate to suppress offensive odors in the ink-receiving layer and provide superior ozone resistance and suppression of bronzing to images formed thereof. In addition, this configuration may suppress increase of the viscosity of the coating liquid for forming the ink-receiving layer to result in good preparation suitability.

In the second aspect, inclusion of the chloride ion-containing zirconium salt and the hydroxy acid derivative in the coating liquid for forming the ink-receiving layer (coating liquid containing fine particles and a water-soluble resin) may facilitate to effective suppression of increase of the viscosity and the bleeding over time of the coating liquid for forming the ink-receiving layer.

In the second aspect, the coating liquid for forming the ink-receiving layer can be prepared, for example, in the following manner.

That is, the coating liquid can be prepared by adding silica fine particles having an average primary particle diameter of 20 nm or less to water mixed with a dispersant, using CONTI-TDS (trade name, manufactured by DALTON Co., Ltd.) (for example, 15% by mass to 25% by mass), dispersing the resultant using a collision-type high-pressure homogenizer (for example, trade name: ULTIMIZER, manufactured by Sugino Machine Ltd.) at a pressure of, for example, 120 MPa, and then adding an aqueous polyvinyl alcohol solution thereto (for example, PVA added to about ⅕ by mass of the silica). The obtained coating liquid is a uniform sol, and by applying this on a support by an application method described below, an ink-receiving layer with a porous structure having a three-dimensional network can be obtained.

If desired, a crosslinking agent, a viscosity-reducing agent, a basic compound, a mordant, a surfactant, an antifoaming agent, an antistatic agent, and/or the like may be further added to the coating liquid for forming the ink-receiving layer.

As the disperser used for dispersion in the preparation of a coating liquid for forming the ink-receiving layer, various conventionally known dispersers such as a high speed rotating disperser, a medium stirring type disperser (a ball mill, a bead mill, a sand mill, and the like), an ultrasonic disperser, a colloid mill disperser, and a high-pressure disperser can be used, and a medium stirring type disperser, a colloid mill disperser, and a high-pressure disperser (homogenizer) may be preferably used in view of efficiently dispersing the lumps of fine particles formed. As the disperser, mainly, a medium stirring type disperser such as a bead mill and the like is suitably used. A high speed wet-type colloid mill disperser (for example, CLEARMIX W MOTION, manufactured by M Technique Co., Ltd., and the like) or a high-pressure homogenizer (for example, ULTIMIZER, manufactured by Sugino Machine Ltd., and the like) may also be used in view of promoting production of fine particles and obtaining high printing density characteristics.

Formation of the ink-receiving layer may be accomplished by, for example, applying the coating liquid for forming the ink-receiving layer onto a support and drying the coated liquid and drying the coated liquid. Examples of the method of applying the coating liquid include conventionally-known methods using an extrusion die coater, an air doctor coater, a blade coater, a rod coater, a knife coater, a squeeze coater, a reverse roll coater or a bar coater.

In embodiments, the ink-receiving layer may be formed by applying the ink-receiving layer forming liquid (a first coating liquid) over a surface of support, and by applying thereon a basic solution (a second coating liquid) either (1) simultaneously with the application of the ink-receiving layer forming liquid or (2) before the applied ink-receiving layer forming liquid (layer) exhibits a falling-rate drying during drying of the applied ink-receiving layer forming liquid, so that the applied liquid is cured by crosslinking Namely, the incorporation of the basic solution is preferably performed within the period of from the application of the ink-receiving layer forming liquid to the completion of exhibition of a falling-rate drying of the applied liquid. Presence of such a crosslinked (hardened) ink-receiving layer may be preferable from the viewpoints of improving the ink-absorbing capacity and suppressing cracking resistance of the ink-receiving layer.

The pH of the basic solution may be preferably 7.0 or higher, and may be more preferably 7.1 or higher.

The hardening of the ink-receiving layer may be promoted by using the basic solution as an alkali solution. When the pH of the basic solution is set to 7.1 or higher, which is not too near to acidic region, the crosslinking reaction of the water-soluble resin such as the PVA may well progress, and defects in the ink-receiving layer such as bronzing and cracking may be suppressed.

The basic solution may be prepared by, for example, adding, to ion-exchanged water, 1% by mass to 5.0% by mass of a basic compound, and other components (such as 0% by mass to 1.0% by mass of the crosslinking agent, 0.01% by mass to 1.0% by mass of a surfactant, and a metal compound) which may be incorporated thereinto if necessary, and sufficiently stirring the resulted mixture. Here, "%" for each compound means % by mass with respect to the total mass of the basic solution.

The period expressed by "before the coating layer shows falling-rate drying" usually refers to a period of several minutes from immediately after the application of the coating liquid, and, in this period, the applied coating layer shows the phenomenon of "constant-rate drying" whereby the solvent (dispersion medium) content in the coating layer decreases in proportion to a lapse of time. With respect to the period during which the constant-rate drying is observed, Kagaku Kogaku Binran (Handbook of Chemical Technology), pages 707-712, MARUZEN Co., Ltd. (Oct. 25, 1980), the disclosure of which is incorporated by reference herein, may be referenced, for example.

After the application of the coating liquid for forming the ink-receiving layer, the coating layer is dried until the coating layer shows a falling-rate drying. The drying may be performed generally at from 40° C. to 180° C. for from 0.5 minutes to 10 minutes (preferably from 0.5 minutes to 5 minutes). Although the drying time naturally varies with the coating amount, the range specified above may be usually appropriate.

At least one of the coating liquid for forming the ink-receiving layer (first coating liquid) and the basic solution (second coating liquid) may preferably contain the crosslinking agent. The ink-receiving layer which is obtained by applying a solution containing a basic compound (second coating liquid) to the first coating liquid either (1) at the same time as above or (2) during drying, performing crosslinking and curing may be preferable for its advantages such as improvement of ink absorptivity and suppression of cracking, as well as improvement of appearance of recorded medium by suppressing defects such as partial image deletion, and improvement of the density of printed images.

In embodiments, in the second aspect, the water-soluble aluminum salt may be applied by being added to at least one of the first coating liquid (coating liquid containing fine particles and a water-soluble resin) and the second coating liquid (basic solution). In preferable embodiments, the water-soluble aluminum salt may be added to at least the first coating liquid. In other embodiments, the water-soluble aluminum salt may be added to the first coating liquid with in-line manner upon applying the first coating liquid.

Examples of a method of applying the basic liquid onto the coating layer formed from the liquid for forming the ink-receiving layer exhibits the falling-rate drying include (1) a method in which the basic liquid is further applied to the coating layer, (2) a method in which the basic liquid is applied by using a method such as spraying and (3) a method in which a support on which the coating layer is previously formed is dipped in the basic liquid.

When the basic liquid is applied by a conventionally-known method using a coater, the method may be preferably selected from those which avoid direct contact of the coater with the coating layer formed from the liquid for forming the ink-receiving layer. Examples of such indirect-contacting method include those using extrusion die coater, a curtain flow coater, or a bar coater.

In embodiments, in the first aspect, the coating film may be preferably dried at 70° C. to 120° C. to reach a solid content concentration of 14% to 20%, and then the coating film is further dried at 40° C. to 60° C. to reach a solid content concentration of 21% to 30%, from the viewpoint of improving the glossiness and the ink-receiving property.

The layer thickness of the ink-receiving layer may be determined in relation to the porosity of the ink-receiving layer so that the ink-receiving layer have a thickness that renders an absorption capacity enough for absorbing all liquid droplets applied by inkjet recording. For example, the layer thickness may be preferably about 15 μm or more when the amount of the ink is 8 nL/mm$^2$ and the porosity is 60%. In consideration of these conditions, the layer thickness of the ink-receiving layer may be preferably from 10 μm to 50 μm.

The ink-receiving layer may preferably have excellent transparency. The criterion of the preferable transparency may be that the ink-receiving layer formed on a transparent film support has a haze value of 30% or less, and more preferably 20% or less. The haze value can be measured using a haze meter "HGM-2DP" (trade name, manufactured by Suga Test Instrument Co., Ltd.).

Examples of the solvent used for preparing the coating liquids include water, an organic solvent, and a mixture thereof. Examples of the organic solvent include: alcohols such as methanol, ethanol, n-propanol, i-propanol, and methoxypropanol; ketones such as acetone and methyl ethyl ketone; tetrahydrofuran; acetonitrile; ethyl acetate; and toluene.

The coating amount of the basic liquid may be generally from 1 g/m$^2$ to 50 g/m$^2$, and may be preferably from 2 g/m$^2$ to 15 g/m$^2$.

After applying the basic solution, drying and curing may be generally carried out by performing heating at a temperature of 40° C. to 180° C. for 0.5 minutes to 30 minutes. In embodiments, the heating may be performed at 40° C. to 150° C. for 1 minute to 20 minutes. For example, if the crosslinking agent contained in the coating liquid for forming the ink-receiving layer is borax or boric acid, the heating may be performed at a temperature of 60° C. to 100° C. for 5 minutes to 20 minutes.

In embodiments, when the basic solution is applied simultaneously with the application of the coating liquid for forming the ink-receiving layer, the ink-receiving layer may be formed by applying the coating liquid for forming the ink-receiving layer and the basic solution simultaneously on the support such that the coating liquid for forming the ink-receiving layer contacts with the support (multi-layer application), and then performing drying and curing.

The simultaneous application (multi-layer application) can be performed, for example, by a coating method using an extrusion die coater or a curtain flow coater. The thus-formed coated layer may be dried after the simultaneous application. The layer may be usually dried by heating at 40° C. to 150° C. for 0.5 minutes to 10 minutes, and preferably at 40° C. to 100° C. for 0.5 minutes to 5 minutes.

When the simultaneous application (multi-layer application) may be performed, for example, with the extrusion die coater, two kinds of the simultaneously discharged coating liquids may form multi-layers in the vicinity of the discharge port of the extrusion die coater, that is, before transferring onto the support, and applied to form the multi-layers on the support.

After forming the ink-receiving layer on the support, the ink-receiving layer can be subjected to a calendering treatment by passing it through roll nips under heat and pressure, for example, by using a super calender, a gloss calender, or the like, for improvement of the surface smoothness, glossiness, transparency, and strength of the coating layer. Since there are cases that the calendering treatment causes a decrease in the porosity (i.e., because it sometimes causes a decrease in ink absorptivity), the calendering treatment may be performed under conditions set to reduce the decrease in the porosity.

The temperature of a roll used when the calendering treatment is carried out may be preferably from 30° C. to 150° C., and more preferably from 40° C. to 100° C. The linear pressure between the rolls during the calendering treatment may be preferably from 50 kg/cm to 400 kg/cm, and more preferably from 100 kg/cm to 200 kg/cm.

Support

There is no particular limitation to the support. Examples thereof include a transparent support formed of a transparent material such as plastic and an opaque support formed of non-transparent material such as paper described in paragraphs [0139] to [0155] of JP-A No. 246988. In embodiments, this opaque support may be preferably one having a surface, to which the ink-receiving layer is to be formed, having a glossiness of 40% or higher. The glossiness is a value determined according to the method described in JIS P8142, that is a test method for specular gloss of paper and paperboard at 75 degree, the disclosure of that is incorporated by reference herein, and that corresponds to ISO 8254-1 (1999) with minimum modification, and the disclosure of which is herein incorporated by reference. Specific examples of the support include: high-gloss paper supports such as art paper, coat paper, cast coat paper and baryta paper used for a silver-halide photographic support; opaque high-gloss films formed of white pigment containing-plastic films such as polyesters (such as polyethylene terephthalate (PET)), cellulose esters such as nitrocellulose, cellulose acetate, and cellulose acetate butylate, polysulfones, polyphenylene oxides, polyimides, polycarbonates and polyamides (the films being optionally subjected to a surface calender treatment); and supports having, on the surface of a transparent support or a high-gloss film containing a white pigment and/or the like, a polyolefin layer which contains or not contain a white pigment. Specific examples of the support further include a white pigment-containing foamed polyester films (such as a foamed PET containing polyolefin fine particles and having voids formed through stretching) and a resin-coated paper used for silver-halide photographic printing paper.

The thickness of the opaque support is not particualry limited. In embodiments, the thickness may be preferably from 50 μm to 300 μm from the viewpoint of handling property. In embodiments, the surface of the water non-absorptive support may be treated with a corona discharge treatment, glow discharge treatment, flame treatment or UV ray irradiation treatment for improving wettability and adhesiveness.

A base paper is used for forming the paper support such as the resin-coated paper. The main raw material of the base paper may be a wood pulp. When making the base paper, synthetic pulp such as polypropylene or synthetic fiber such as nylon or polyester may be optionally used in addition to the wood pulp. Any of LBKP, LBSP, NBKP, NBSP, LDP, NDP, LUKP, or NUKP may be used as the wood pulp. In embodiments, it may be preferable to increase the total amount of LBKP, NBSP, LBSP, NDP and LDP, which have high contents of short fibers. In embodiments, the proportion of LBSP and/or LDP may be preferably from 10% by mass to 70% by mass.

The pulp may be preferably a chemical pulp (such as sulfate pulp or sulfite pulp) which has a less impurity content. A pulp of which whiteness has been improved by bleaching treatment may be also useful.

In embodiments, one or more of the following agents may be appropriately added into the base paper as necessary: a sizing agent such as a high fatty acid or an alkylketene dimer, a white pigment such as calcium carbonate, talc, or titanium oxide, a paper-strength enhancing agent such as starch, polyacrylamide, or polyvinyl alcohol, a fluorescent whitening agent, a moisturizing agent such as a polyethylene glycol, a dispersant, a softener such as quaternary ammonium, or the like.

The freeness of the pulp used for paper-making may be preferably from 200 mL to 500 mL in terms of C.S.F (Canadian Standard Freeness). Further, concerning the fiber length after beating, the sum of the percentage by mass of the pulp remaining on a 24-mesh screen and the percentage by mass of the pulp remaining on a 42-mesh screen according to JIS P-8207 (which is incorporated herein by reference) may be preferably from 30% by mass to 70% by mass. In addition, the percentage by mass of the pulp remaining on a 4-mesh screen may be preferably 20% by mass or less.

The basis weight of the base paper may be preferably from 30 g/m$^2$ to 250 g/m$^2$, and more preferably from 50 g/m$^2$ to 200 g/m$^2$. The thickness of the base paper may be preferably from 40 μm to 250 μm. High smoothness may also be rendered to the base paper by subjecting the base paper to calender treatment during or after paper-making The density of the base paper is generally from 0.7 g/cm$^3$ to 1.2 g/cm$^3$ (according to JIS P8118, the disclosure of which is incorporated herein by reference). JIS P8118 substantially corresponds to ISO 534: 1988. The pH of the base paper may be from 5 to 9 when measured by a hot water extraction method provided by JIS P-8113, the disclosure of which is incorporated by reference herein.

One or both sides of the base paper may be coated with a surface sizing agent, examples of which are similar to the sizing agent which can be included in the base paper.

In embodiments, the front surface and the back surface of the base paper may be covered with a polyethylene, generally with a low-density polyethylene (LDPE) and/or a high-density polyethylene (HDPE). LLDPE, polypropylene, or the like may also be used in addition to the polyethylene. In embodiments in which the polyethylene layer is provided on the side (surface) over which the ink-receiving layer is to be formed, the polyethylene layer may preferably contain at least one of a rutile- or anatase-type titanium oxide, a fluorescent whitening agent, and ultramarine pigment for improving the opacity, whiteness, and hue, as is widely performed in manufacturing of photographic printing papers. The content ratio of the titanium oxide to the polyethylene is preferably approximately from 3% to 20% by mass, more preferably approximately from 4% to 13% by mass. The thickness of the polyethylene layer on the front or back surface is not particularly limited. In embodiments, the thickness may be preferably from 10 μm to 50 μm. In embodiments, an undercoat layer may be formed on the polyethylene layer to increase the adhesion to the ink-receiving layer. The undercoat layer preferably contains an aqueous polyester, a gelatin, or a PVA. The thickness of the undercoat layer may be preferably from 0.01 μm to 5 μm.

The polyethylene-coated paper may be in a form of a glossy paper, and may be used in a form of one having a mat surface or a fine grain surface as common in photographic printing paper that is formed by subjecting the base paper to a so-called embossing treatment.

A water-impermeable support may be preferable as the support in view of suppressing deformation such as curling accompanying the image recording. Here, the "water-impermeable" refers to a property that water is not absorbed or the absorptivity of water is 0.3 g/m$^2$ or less.

The glossiness of the water-impermeable support surface is not particularly limited. In embodiments, it may be preferably 40% or more, more preferably from 45% to 95%, and even more preferably from 50% to 85%, in view of enabling to prepare a semi-glossy product by using any one of a high-gloss support, a low-gloss support, and the like, thereby increasing alternatives for the support. It may be preferable that the glossiness of the both sides of the water-impermeable support is within the above-described range.

The support may be provided with a back-coat layer. Examples of a component which may be contained in the back-coat layer incldue a white pigment, an aqueous binder, and the like. Paragraphs [0063] to [0064] of JP-A No. 2009-107319 describe preferable details and embodiments of the white pigment, the aqueous binder, and the like.

EXAMPLES

Specific embodiments are described below with reference to Examples without intension of restricting the scope of the invention. "Part(s)" and "%" described in Examples means "part(s) by mass" and "% by mass" respectively, unless otherwise noted.

Examples 1 to 8 and Comparative examples 1 to 12

Preparation of Support 50 parts of an acacia LBKP and 50 parts of an aspen LBKP were beaten by a disc refiner into Canadian Freeness of 300 ml respectively, to prepare a pulp slurry. After adding 1.3% of a cationic starch (trade name: CATO 304L, manufactured by Nippon NSC Ltd.), 0.15% of an anionic polyacrylamide (trade name: DA4104, manufactured by Seiko PMC Corporation), 0.29% of an alkyl ketene dimer (trade name: SIZEPINE K, manufactured by Arakawa Chemical Industries, Ltd.), 0.29% of an epoxidized behenic amide, and 0.32% of a polyamide polyamine epichlorohydrin (trade name: ARAFIX 100, manufactured by Arakawa Chemical Industries, Ltd.) to the pulp slurry, 0.12% of an antifoaming agent was further added thereto. The percentages of the added components were based on the mass of the pulp.

The resultant pulp slurry was subjected to paper-making by a fourdrinier paper machine, and then dried. In the drying, the felt surface of the web was pressed against a drum dryer cylinder via a dryer canvas, with adjusting the tensile force of the dryer canvas to 1.6 kg/cm. Then, a polyvinyl alcohol (trade name: KL-118, manufactured by Kuraray Co., Ltd.) was applied at 1 g/m$^2$ to both the surfaces of the resultant using a size press, and the applied polyvinyl alcohol was dried and subjected to a calender treatment. A base paper (the raw paper) having a basis weight of 166 g/m$^2$ and a thickness of 160 μm was thus obtained.

The wire surface of the obtained raw paper (a back side) was subjected to a corona discharge treatment, and then provided with a thermoplastic resin layer having a thickness of 25 μm and a mat surface by coating a high-density polyethylene using a melt extruder. The thermoplastic resin layer provided onto the back side was further subjected to a corona discharge treatment. Then, an aqueous dispersion liquid of aluminum oxide and silicone dioxide was applied as an antistatic agent to the thermoplastic resin layer such that the dry mass was 0.2 g/m$^2$. Herein, this aqueous dispersion was previously prepared by dispersing aluminum oxide (trade name: ALMINA SOL 100, manufactured by Nissan Chemical Industries Co., Ltd.) and silicon dioxide (trade name: SNOW-TEX O, manufactured by Nissan Chemical Industries Co., Ltd.) at a ratio by mass of 1:2. Then, a front side, which is a side opposite to the back side of the base paper, was subjected to a corona discharge treatment, and then provided with polyethylene having a density of 0.93 g/cm$^3$ using a melt extruder to result in its applied amount of 24 g/m$^2$. A support was thus obtained.

Preparation of Silica Sispersion 19.5 kg of gas phase process silica fine particles (trade name: AEROSIL 300SF75, manufactured by Nippon Aerosil Co., Ltd.), 1.70 kg of SHALLOL DC-902P (trade name, an aqueous dispersion of a cationic resin, manufactured by Dai-ichi Kogyo Seiyaku Co., Ltd.), 1.05 kg of ZA-30 (trade name, an aqueous dispersion of a water-soluble polyvalent metal salt zirconyl acetate, manufactured by Daiichi Kigenso Kagaku Kogyo Co., Ltd.), and 77.74 kg of ion-exchange water were mixed using an induction disperser (trade name: CONTI-TDS, manufactured by Dalton Corporation) and subjected to dispersing using a counter collision high-pressure homogenizer (trade name: ULTIMIZER, manufactured by Sugino Machine Co., Ltd.) at 130 MPa. The thus obtained dispersion was maintained for 20 with heating at 45° C. A silica dispersion having a silica content of 19.5% based on the total amount thereof was thus obtained.

Preparation of Coating Liquid

A coating liquid was prepared by adding, to 45.65 parts of the silica dispersion, 4.69 parts of ion-exchange water, 6.56 parts of an aqueous solution of boric acid, 0.56 parts of an aqueous solution of a hydroxycarboxylic acid shown in the following Tables 1-1 and 1-2, 0.05 parts of polyalkylene polyamine-dimethylamine-epichlorohydrin condensate (trade name: HYMAX SC507, manufactured by HYMO Co., Ltd.), 25.93 parts of a 7%-aqueous solution of PVA-235 (trade name, manufactured by Kuraray Co., Ltd., saponification degree: 88%, polymerization degree: 3500), 0.59 parts of 10%-aqueous solution of EMULGEN 109P (trade name, manufactured by Kao Corp., polyoxyethylene lauryl ether), 0.27 parts of diethylene glycol monobutyl ether (trade name: BUTYCENOL 20P, manufactured by Kyowa Hakko Chemical Co.), and 1.76 parts of a cationic polyurethane latex (trade name: SUPERFLEX 6500-5, manufactured by Dai-ichi Kogyo Seiyaku Co., Ltd) at 30° C.

Preparation of Basic Solution

A basic solution was prepared by mixing and stirring a mixture having the following formulation.

Formulation of Basic Solution:

| | |
|---|---|
| Boric acid | 0.65 parts |
| Ammonium carbonate (1st grade, manufactured by Kanto Kagaku Co. Inc.) | 4.0 parts |
| Ion-exchange water | 89.35 parts |
| Polyoxyethylene lauryl ether (trade name: EMULGEN 109P, manufactured by Kao Corp., polyoxyethylene lauryl ether) | 6 parts |

Preparation of Aqueous Solution of Basic Polyaluminum Hydroxide

An aqueous solution of basic polyaluminum hydroxide was prepared by mixing and stirring a mixture having the following formulation.

Formulation of Aqueous Solution of Basic Polyaluminum Hydroxide:

| | |
|---|---|
| ALFINE 83 (trade name, manufactured by TAIMEI CHEMICALS CO., LTD., an aqueous solution of basic polyaluminum hydroxide) | 20 parts |
| Ion-exchange water | 80 parts |

Production of Inkjet Recording Paper

The front side of the support was subjected to a corona discharge treatment, and thereto, an ink receiving layer-forming liquid, which was prepared by in-line mixing of the coating liquid provided at a rate of 13.2 ml/m$^2$ with the aqueous solution of basic polyaluminum hydroxide solution provided at a rate of 9.1 ml/m$^2$, was further provided. The coated ink receiving layer-forming liquid was dried with a hot-air dryer (air-blow speed: 3 msec to 8 msec) at 80° C. until the solid content of the dried layer reached 23%. This coated layer showed constant-rate drying during this drying process. Immediately thereafter, the support was immersed in the basic solution for 3 seconds so that an amount of the coated basic solution became 8 g/m$^2$, and further subjected to drying at 80° C. for 10 minutes. An inkjet recording paper was thus obtained.

Evaluations

The ink receiving layer-forming liquid and the inkjet recording paper were subjected to tests for evaluation as follows. Results of the evaluation tests are shown in Tables 1-1 and 1-2.

(1) Condition of Ink Receiving Layer-Forming Liquid

The ink receiving layer-forming liquid was maintained at 30° C. for 24 hrs and then subjected to measurement of viscosity η using a viscometer (trade name: MODEL B VISCOMETER, manufactured by Toki Sangyo Co., Ltd.) at a rotation rate of 60 rpm with maintaining the temperature of the liquid at 30° C. The thus-measured value of viscosity was regarded as index of for being evaluated under the following criteria.

Criteria for evaluation of Condition of Ink receiving layer-forming liquid:

A: The viscosity was 200 mP·s or less.

B: The viscosity was more than 200 mP·s but 500 mP·s or less.

C: The viscosity was more than 500 mP·s.

(2) Image Density (Dmax)

On each of the obtained inkjet recording media, a black solid image was formed under environmental conditions of 23° C. and 50% RH using an inkjet printer PM-A820 (trade name, manufactured by Seiko Epson Corporation) under conditions for obtaining a maximum black density (K-Dm). After recording, this black solid image was left for 24 hours to stand under environmental conditions of 23° C. and 50% RH, and the visual reflection density was observed with a densitometer (trade name: X-RITE 538, manufactured by X-rite Inc.).

(3) Low-Humidity Curling

Each of the obtained inkjet recording media was made into a sample piece having an A4 size, and left to stand under environmental conditions of 27° C. and 35% RH for 7 days. After the completion of leaving it to stand, a black solid image was formed on the sample piece using an inkjet printer PM-A820 (manufactured by Seiko Epson Corporation) under the same environment. While placing the image-forming surface of the sample piece facing upward on the desk, the heights of the four edges swollen on the desk from the desk surface were measured and averaged, and the low-humidity curling degree was evaluated from the average values according to the following evaluation criteria.

Evaluation Criteria:

A: Less than 3 mm

B: 3 mm or more but less than 8 mm

C: 8 mm or more

TABLE 1-1

| | Hydroxycarboxylic acid compound | | | | | Evaluation | | |
|---|---|---|---|---|---|---|---|---|
| | Type | Number of OH in molecule | Number of COOH in molecule | I/O value | Addition amount [mol/kg] (with respect to fumed silica) | Coating liquid conditions | Image Density (K − Dm) | Low-humidity curling at 27° C./35% RH |
| Ex. 1 | Methyl lactate | 1 | 0 | 2.00 | 0.61 | A | 2.63 | A |
| Ex. 2 | Methyl lactate | 1 | 0 | 2.00 | 0.20 | A | 2.67 | A |
| Ex. 3 | Methyl lactate | 1 | 0 | 2.00 | 1.50 | A | 2.42 | A |
| Ex. 4 | Ethyl lactate | 1 | 0 | 1.67 | 0.61 | A | 2.66 | A |
| Comp. Ex. 1 | Methyl lactate | 1 | 0 | 2.00 | 0.05 | C | 2.70 | A |
| Comp. Ex. 2 | Methyl lactate | 1 | 0 | 2.00 | 2.5 | A | 2.10 | A |
| Comp. Ex. 3 | Butyl lactate | 1 | 0 | 1.17 | 0.61 | C | 2.65 | C |
| Ex. 5 | Ethyl malate | 1 | 1 | 2.58 | 0.61 | B | 2.50 | B |
| Ex. 6 | Ethyl Tartrate | 2 | 1 | 3.42 | 0.61 | B | 2.48 | B |
| Ex. 7 | Methyl glycolate | 1 | 1 | 2.67 | 0.61 | A | 2.59 | A |
| Ex. 8 | Ethyl glycolate | 1 | 1 | 2.00 | 0.61 | A | 2.62 | B |

TABLE 1-2

| | Hydroxycarboxylic acid compound | | | | | Evaluation | | |
|---|---|---|---|---|---|---|---|---|
| | Type | Number of OH in molecule | Number of COOH in molecule | I/O value | Addition amount [mol/kg] (with respect to fumed silica) | Coating liquid conditions | Image Density (K − Dm) | Low-humidity curling at 27° C./35% RH |
| Comp. Ex. 4 | Mandelic acid | 1 | 1 | 1.66 | 0.61 | C | — | — |
| Comp. Ex. 5 | 3,5-Hydroxy benzoic acid | 2 | 1 | 2.61 | 0.61 | C | — | — |
| Comp. Ex. 6 | Citric acid | 1 | 3 | 4.58 | 0.61 | C | — | — |
| Comp. Ex. 7 | Malic acid | 1 | 2 | 5.00 | 0.61 | C | — | — |
| Comp. Ex. 8 | Tartaric acid | 2 | 2 | 6.25 | 0.61 | C | — | — |
| Comp. Ex. 9 | Ethanol | 1 | 0 | 2.5 | 0.61 | C | — | — |
| Comp. Ex. 10 | Acetic acid | 0 | 1 | 3.75 | 0.61 | A | 2.55 | C |
| Comp. Ex. 11 | Lactic acid | 1 | 1 | 4.17 | 0.61 | A | 2.30 | C |
| Comp. Ex. 12 | Glycolic acid | 1 | 1 | 6.25 | 0.61 | A | 2.25 | C |

As shown in Tables 1-1 and 1-2, Examples, which are within the scope of the first aspect, provided a high-density image while maintaining the low viscosity of the coating liquid, and suppressed curling under low humidity. In contrast, Comparative Examples 1-1 to 1-6 had inferior suitability to application since they could not maintain the low viscosity of the coating liquid for forming the ink-receiving layer. Specifically, Comparative Examples which use a compound which contains no COOH group or one COOH group, has the I/O value of 1.5 or more, and is not an ester revealed failure in maintaining the liquid viscosity to be low, lowered image density, and/or curling under low humidity.

Example 2-1

Preparation of Support

A water-impermeable support was prepared in a substantially similar manner as the support in Example 1-1, except that the thickness of the high-density polyethylene was changed to 30 μm.

Preparation of Ink-Receiving Layer-Forming Liquid (First Liquid)

The (3) fumed silica fine particles, the (4) ion-exchange water, and the (5) "SHALLOL DC-902P" shown in the following formulation list were mixed and subjected to dispersing using a liquid-liquid counter collision-type disperser (trade name: ULTIMIZER-HJP25005, manufactured by Sugino Machine KK), and the resultant dispersion was heated and maintained at 45° C. for 20 hours. Then, the (2) boric acid, the (10) "BUTYCENOL 20P", the (11)"HIMAX SC-507", the (7) "PVA 235" solution, the (8) "SUPERFLEX 650-5" and the (8) "EMULGEN 109P" were added to the resultant dispersion at 30° C., and the (1) zirconyl hydroxychloride was added thereto to provide an ink-receiving layer-forming liquid.

Composition of Coating Liquid for Ink-Receiving Layer

| | |
|---|---|
| (1) Zirconyl hydroxychloride (ZrO(OH)CI) (trade name: ZC-2, solid content 35% (in terms of $ZrO_2$), manufactured by Daiichi Kigenso Kagaku Kogyo Co., Ltd.) | 0.41 parts |
| (2) Lactic acid (hydroxycarboxylic acid derivative, manufactured by Wako Pure Chemical Industries, Ltd.) | 0.32 parts |
| (3) Fumed silica fine particle (inorganic fine particle; trade name: AEROSIL 300SF75, manufactured by Nippon Aerosil Co., Ltd.) | 8.9 parts |
| (4) Ion-exchange water | 44.5 parts |
| (5) Dispersant (trade name: SHAROLL DC-902P, manufactured by Dai-Ichi Kogyo Seiyaku Co., Ltd.; nitrogen-containing organic cation polymer; 51.5% aqueous solution) | 0.78 parts |
| (6) Boric acid (5% aqueous solution) | 6.55 parts |
| (7) PVA235 (described above; water-soluble resin-dissolved solution; 7%) | 25.9 parts |
| (8) Cationic polyurethane latex (trade name: SUPERFLEX 650-5, manufactured by Dai-ichi Kogyo Seiyaku Co., Ltd.) | 1.75 parts |
| (9) Surfactant (trade name: EMULGEN 109P, manufactured by Kao Corp.; 10% aqueous solution) | 0.57 parts |
| (10) Diethylene glycol monobutyl ether (trade name: BUTYCENOL 20P, manufactured by Kyowa Hakko Chemical Co., Ltd.) | 0.27 parts |
| (11) polyalkylpolyaminedimethylamine epichlorhydrin polycondensate (trade name: HYMAX SC-507, manufactured by Hymo Co., Ltd., 70% solution) | 0.05 parts |

Formation of Ink-Receiving Layer (First Liquid)

After subjecting one surface of the water-impermeable support to a corona electrical discharge treatment, the coating liquid for forming the ink-receiving layer (the first liquid) was applied on one surface using an extrusion die coater to form a coating layer. Specifically, the coating liquid for forming the ink-receiving layer supplied at a rate of 132.0 g/m$^2$ and the aqueous poly aluminum chloride solution supplied at a rate 9.1 g/m$^2$ (application amount) were mixed in-line, and the resulted mixture was applied on the support.

The resulted coating layer was subjected to set-drying at a temperature of 10° C. for 5 minutes, and further dried in a hot-air dryer at 80° C. (wind velocity: 3 msec to 8 m/sec). Thereby, an inkjet recording medium 2-1 having the ink-receiving layer on the support was obtained.

Example 2-2

An inkjet recording medium 2-2 was obtained in a substantially similar manner to that in Example 2-1, except that zirconium oxychroride was used instead of the zirconyl hydroxychloride in the preparation of the coating liquid for forming the ink-receiving layer in Example 2-1.

Example 2-3

In a substantially similar manner to that in Example 2-1, the coating liquid for forming the ink-receiving layer was applied to form a coating layer, and dried in a hot-air dryer at 80° C. (wind velocity 3 msec to 8 msec) to achieve a solid content concentration in the coating layer of 23%. This coating layer exhibited a constant-rate drying during the period. Immediately thereafter, the coating layer was immersed in the basic solution (second coating liquid) for 3 seconds to allow the basic solution to deposit on the coating layer at 8 g/m$^2$, and the resultant was further dried at 72° C. for 10 minutes (drying process) to form an ink-receiving layer on one surface of the water-impermeable support. An inkjet recording medium 2-3 having the ink-receiving layer on the support was thus obtained.

Example 2-4

An inkjet recording medium 2-4 was obtained in a substantially similar manner to that in Example 2-3, except that ammonium chloride was used instead of the ammonium carbonate in the preparation of the basic solution.

Examples 2-5 to 2-7

Inkjet recording media 2-5 to 2-7 were obtained in a substantially similar manner to that in Example 2-1, except that the hydroxy acid derivative shown in Table 2-1 was used instead of the lactic acid in the preparation of the coating liquid for forming the ink-receiving layer.

Examples 2-8 to 2-14

Inkjet recording media 2-8 to 2-14 were obtained in a substantially similar manner to that in Example 2-1, except that the addition amounts of the chloride ion-containing zirconium salt, the water-soluble aluminum salt, and lactic acid were each changed to the application amounts shown in Tables 2-1 and 2-2 in the formation of the ink-receiving layer.

Examples 2-15 to 2-18

Inkjet recording media 2-15 to 2-18 were obtained in a substantially similar manner to that in Example 2-1, except that the hydroxy acid derivative shown in Table 2-2 was used instead of the lactic acid in the preparation of the coating liquid for forming the ink-receiving layer.

Examples 2-19 to 2-20

Inkjet recording media 2-19 to 2-20 were obtained in a substantially similar manner to that in Example 2-1, except that the water-soluble aluminum salt shown in Table 2-2 was used as a water-soluble aluminum salt instead of the ALFINE 83 in the formation of the ink-receiving layer.

Comparative Example 2-1

An inkjet recording medium C1 was obtained in a substantially similar manner to that in Example 2-1, except that zirconyl acetate was used instead of the zirconyl hydroxychloride in the preparation of the coating liquid for forming the ink-receiving layer of Example 2-1.

Comparative Examples 2-2 to 2-3

Coating liquids for forming the ink-receiving layer was prepared in a substantially similar manner to that in Example 2-1, except that zirconyl nitrate and zirconyl sulfate were each used instead of the zirconyl hydroxychloride in the preparation of the coating liquid for forming the ink-receiving layer. Herein, the resulted coating liquids were gelled due to remarkable increase of the viscosity, and accordingly, could not be used for applying.

Comparative Example 2-4

An inkjet recording medium C4 was obtained in a substantially similar manner to that in Example 2-1, except that only the coating liquid for forming the ink-receiving layer was applied without in-line mixing the in-line solution therewith in the formation of the ink-receiving layer.

Comparative Example 2-5

An inkjet recording medium C5 was obtained in a substantially similar manner to that in Example 2-1, except that zirconyl hydroxychloride was not added in the preparation of the coating liquid for forming the ink-receiving layer.

Comparative Example 2-6

A coating liquid for forming the ink-receiving layer was prepared in a substantially similar manner to that in Example 2-1, except that lactic acid was not added in the preparation of the coating liquid for forming the ink-receiving layer in Example 2-1. Herein, the resulted coating liquid was gelled due to remarkable increase of the viscosity, and accordingly, could not be used for applying.

Evaluation

Evaluation of Coating Liquid Viscosity

The viscosity of each of the obtained coating liquids for forming the ink-receiving layer was measured after one hour had passed after the preparation of the liquid. The measurement of the viscosity was carried out at 30° C. using a B type viscometer. The results are shown in Tables 3-1 and 3-2.

Evaluation of Offensive Odors

A sensory test for evaluating the offensive odor of the ink-receiving layer of each of the inkjet recording medium was carried out by 10 persons at a position 5 cm from the ink-receiving layer under an environment of 25° C. and 60% RH. Each person conducted the sensory test in accordance with the following evaluation criteria, and an average evaluation score was determined from the results of the sensory evaluations done by the 10 persons. Average evaluation scores (Round off the numbers below decimal point) are shown in Tables 3-1 and 3-2.

Evaluation Criteria

Score 3: No offensive odor was sensed at all.

Score 2: Practically acceptable, although a little offensive odor was sensed.

Score 1: Practically problematic offensive odor was sensed.

Evaluation of Ozone Resistance

A magenta solid image and a cyan solid image were printed on each of the inkjet recording media using an inkjet printer DL410 (trade name, manufactured by Fujifilm Corporation) and its genuine inks to obtain a sample for evaluation. The sample was stored under an atmosphere at 23° C./60% RH and an ozone concentration of 10 ppm for 96 hours. The optical densities of the magenta image and the cyan image before and after the storage of the sample were respectively measured by a reflection densitometer (trade name: X-RITE 938, manufactured by X-rite Inc.). The concentration remaining rate after the test was determined by the following equation, and taken as an index for evaluating the ozone resistance. The results are shown in Tables 3-1 and 3-2.

Ozone resistance (%)=[(Density after test of ozone resistance)/(Density before test of ozone resistance)]×100

Evaluation of Light Resistance

A solid image was printed with a cyan ink on each of the inkjet recording media using an inkjet printer DL40 (trade name, manufactured by Fujifilm Corporation) and its genuine ink to achieve a reflection density after drying of 0.6. This was left to stand under an environment of 23° C./50% RH for 24 hours to obtain a sample for evaluation. A light resistance test was conducted on the sample with irradiating a xenon light at an illumination of 75,000 lux for 28 days through a filter (trade name: SC37, manufactured by Fujifilm Corporation) using an ATLAS FADE METER Ci 5000 (trade name, manufactured by Atlas Electric Devices Co.). The reflection densities of the cyan image of the sample before and after the test of the light resistance were respectively measured, and the concentration remaining rate after the test of the light resistance was determined by the following equation, and taken as an index for evaluating the light resistance. The results are shown in Tables 3-1 and 3-2.

Light resistance (%)=[(Density after test of light resistance)/(Density before test of light resistance)]×100

Evaluation of Density of Printed Images

A black solid image was printed on each of the inkjet recording media using an inkjet printer DL410 (manufactured by Fujifilm Corporation) and its genuine ink under an environment of 23° C./50% RH, and the optical density (O.D.) of the black solid image was measured by a reflection densitometer (trade name: X-RITE938, manufactured by X-rite Inc.). The results are shown in Tables 3-1 and 3-2.

Evaluation of Bronzing

Each of the inkjet recording media was subjected to humidity conditioning under an environment of 35° C./80% RH for 16 hours. A cyan solid image was then printed thereon using an inkjet printer DL410 (trade name, manufactured by Fujifilm Corporation) and its genuine ink under an environment of 35° C./80% RH with regulating the tone of the image data after drying to provide a reflection density on the inkjet recording medium of 1.0±0.1.

Then, the cyan solid image portion was visually observed, and bronzing (revealing of bronze gloss) was evaluated in accordance with the following evaluation criteria. The results are shown in Tables 3-1 and 3-2.

Evaluation Criteria

A: Bronze gloss was not generated at all.

B: Practically acceptable, although a hardly noticeable bronze gloss was observed.

C: Practically problematic bronze gloss was observed.

TABLE 2-1

| | Zirconium salt | | | Water-soluble aluminum salt | | | Hydroxy acid derivative | | | |
|---|---|---|---|---|---|---|---|---|---|---|
| | Type | Coating amount ($g/m^2$) | Mass ratio (with respect to inorganic fine particles) | Type | Coating amount ($g/m^2$) | Mass ratio (with respect to inorganic fine particles) | Type | Coating amount ($g/m^2$) | Mass ratio (with respect to zirconium salt) | Basic compound |
| Ex. 2-1 | ZrO(OH)Cl | 0.21 | 0.016 | ALFINE 83 | 0.42 | 0.032 | Lactic acid | 0.41 | 1.95 | — |
| Ex. 2-2 | $ZrOCl_2$ | 0.21 | 0.016 | ALFINE 83 | 0.42 | 0.032 | Lactic acid | 0.41 | 1.95 | — |
| Ex. 2-3 | ZrO(OH)Cl | 0.21 | 0.016 | ALFINE 83 | 0.42 | 0.032 | Lactic acid | 0.41 | 1.95 | Ammonium carbonate |

TABLE 2-1-continued

| | Zirconium salt | | | Water-soluble aluminum salt | | | Hydroxy acid derivative | | | |
|---|---|---|---|---|---|---|---|---|---|---|
| | Type | Coating amount ($g/m^2$) | Mass ratio (with respect to inorganic fine particles) | Type | Coating amount ($g/m^2$) | Mass ratio (with respect to inorganic fine particles) | Type | Coating amount ($g/m^2$) | Mass ratio (with respect to zirconium salt) | Basic compound |
| Ex. 2-4 | ZrO(OH)Cl | 0.21 | 0.016 | ALFINE 83 | 0.42 | 0.032 | Lactic acid | 0.41 | 1.95 | Ammonium chloride |
| Ex. 2-5 | ZrO(OH)Cl | 0.21 | 0.016 | ALFINE 83 | 0.42 | 0.032 | Glycolic acid | 0.41 | 1.95 | — |
| Ex. 2-6 | ZrO(OH)Cl | 0.21 | 0.016 | ALFINE 83 | 0.42 | 0.032 | Quinic acid | 0.41 | 1.95 | — |
| Ex. 2-7 | ZrO(OH)Cl | 0.21 | 0.016 | ALFINE 83 | 0.42 | 0.032 | Glyceric acid | 0.41 | 1.95 | — |
| Ex. 2-8 | ZrO(OH)Cl | 0.42 | 0.032 | ALFINE 83 | 0.42 | 0.032 | Lactic acid | 0.41 | 0.98 | — |
| Ex. 2-9 | ZrO(OH)Cl | 1.50 | 0.115 | ALFINE 83 | 0.42 | 0.032 | Lactic acid | 0.41 | 0.27 | — |
| Ex. 2-10 | ZrO(OH)Cl | 0.21 | 0.016 | ALFINE 83 | 0.84 | 0.064 | Lactic acid | 0.41 | 1.95 | — |
| Ex. 2-11 | ZrO(OH)Cl | 0.21 | 0.016 | ALFINE 83 | 1.50 | 0.115 | Lactic acid | 0.41 | 1.95 | — |
| Ex. 2-12 | ZrO(OH)Cl | 0.21 | 0.016 | ALFINE 83 | 0.42 | 0.032 | Lactic acid | 0.10 | 0.48 | — |
| Ex. 2-13 | ZrO(OH)Cl | 0.21 | 0.016 | ALFINE 83 | 0.42 | 0.032 | Lactic acid | 1.00 | 4.76 | — |

TABLE 2-2

| | Zirconium salt | | | Water-soluble aluminum salt | | | Hydroxy acid derivative | | | |
|---|---|---|---|---|---|---|---|---|---|---|
| | Type | Coating amount ($g/m^2$) | Mass ratio (with respect to inorganic fine particles) | Type | Coating amount ($g/m^2$) | Mass ratio (with respect to inorganic fine particles) | Type | Coating amount ($g/m^2$) | Mass ratio (with respect to zirconium salt) | Basic compound |
| Ex. 2-14 | ZrO(OH)Cl | 0.21 | 0.016 | ALFINE 83 | 0.42 | 0.032 | Lactic acid | 1.50 | 7.14 | — |
| Ex. 2-15 | ZrO(OH)Cl | 0.21 | 0.016 | ALFINE 83 | 0.42 | 0.032 | Methyl lactate | 0.41 | 1.95 | — |
| Ex. 2-16 | ZrO(OH)Cl | 0.21 | 0.016 | ALFINE 83 | 0.42 | 0.032 | Ethyl lactate | 0.41 | 1.95 | — |
| Ex. 2-17 | ZrO(OH)Cl | 0.21 | 0.016 | ALFINE 83 | 0.42 | 0.032 | 2,2-Bis(hydroxymethyl) propionic acid | 0.41 | 1.95 | — |
| Ex. 2-18 | ZrO(OH)Cl | 0.21 | 0.016 | ALFINE 83 | 0.42 | 0.032 | 2,2-Bis(hydroxymethyl) butanoic acid | 0.41 | 1.95 | — |
| Ex. 2-19 | ZrO(OH)Cl | 0.21 | 0.016 | Aluminum sulfate | 0.42 | 0.032 | Lactic acid | 0.41 | 1.95 | — |
| Ex. 2-20 | ZrO(OH)Cl | 0.21 | 0.016 | Potassium aluminum sulfate | 0.42 | 0.032 | Lactic acid | 0.41 | 1.95 | — |

TABLE 2-3

| | Zirconium salt | | | Water-soluble aluminum salt | | | Hydroxy acid derivative | | | |
|---|---|---|---|---|---|---|---|---|---|---|
| | Type | Coating amount ($g/m^2$) | Mass ratio (with respect to inorganic fine particles) | Type | Coating amount ($g/m^2$) | Mass ratio (with respect to inorganic fine particles) | Type | Coating amount ($g/m^2$) | Mass ratio (with respect to zirconium salt) | Basic compound |
| Comp. Ex. 2-1 | $ZrO(CH_3COO)_2$ | 0.21 | 0.016 | ALFINE 83 | 0.42 | 0.032 | Lactic acid | 0.41 | 1.95 | — |
| Comp. Ex. 2-2 | $ZrO(NO_3)_2$ | 0.21 | 0.016 | ALFINE 83 | 0.42 | 0.032 | Lactic acid | 0.41 | 1.95 | — |
| Comp. Ex. 2-3 | $ZrO(SO_4)$ | 0.21 | 0.016 | ALFINE 83 | 0.42 | 0.032 | Lactic acid | 0.41 | 1.95 | — |
| Comp. Ex. 2-4 | ZrO(OH)Cl | 0.21 | 0.016 | ALFINE 83 | — | — | Lactic acid | 0.41 | 1.95 | — |
| Comp. Ex. 2-5 | — | — | — | ALFINE 83 | 0.42 | 0.032 | Lactic acid | 0.41 | 1.95 | — |
| Comp. Ex. 2-6 | ZrO(OH)Cl | 0.21 | 0.016 | ALFINE 83 | 0.42 | 0.032 | — | — | — | — |

TABLE 3-1

| | Coating liquid viscosity (mPa · s) | Evaluation of offensive odor | Ozone resistance | | Light resistance | Optical density | Bronzing |
|---|---|---|---|---|---|---|---|
| | | | Magenta | Cyan | | | |
| Ex. 2-1 | 100 | 3 | 85 | 85 | 90 | 2.10 | A |
| Ex. 2-2 | 130 | 3 | 84 | 85 | 89 | 2.05 | A |

TABLE 3-1-continued

| | Coating liquid viscosity (mPa · s) | Evaluation of offensive odor | Ozone resistance Magenta | Ozone resistance Cyan | Light resistance | Optical density | Bronzing |
|---|---|---|---|---|---|---|---|
| Ex. 2-3 | 100 | 3 | 80 | 80 | 89 | 2.50 | A |
| Ex. 2-4 | 100 | 3 | 80 | 80 | 90 | 2.52 | A |
| Ex. 2-5 | 120 | 3 | 85 | 84 | 91 | 2.10 | A |
| Ex. 2-6 | 80 | 3 | 85 | 85 | 91 | 2.12 | A |
| Ex. 2-7 | 80 | 3 | 85 | 83 | 92 | 2.12 | A |
| Ex. 2-8 | 100 | 3 | 85 | 85 | 91 | 2.07 | A |
| Ex. 2-9 | 300 | 3 | 85 | 86 | 91 | 2.00 | A |
| Ex. 2-10 | 100 | 3 | 88 | 88 | 92 | 2.15 | A |
| Ex. 2-11 | 105 | 3 | 90 | 91 | 90 | 2.12 | A |
| Ex. 2-12 | 350 | 3 | 85 | 85 | 90 | 2.20 | A |
| Ex. 2-13 | 70 | 3 | 85 | 85 | 90 | 2.05 | A |
| Ex. 2-14 | 55 | 3 | 88 | 90 | 91 | 1.95 | A |
| Ex. 2-15 | 350 | 3 | 85 | 85 | 90 | 2.25 | A |
| Ex. 2-16 | 400 | 3 | 85 | 85 | 90 | 2.23 | A |
| Ex. 2-17 | 300 | 3 | 85 | 85 | 90 | 2.12 | A |
| Ex. 2-18 | 350 | 3 | 85 | 85 | 90 | 2.15 | A |
| Ex. 2-19 | 100 | 3 | 85 | 85 | 91 | 2.10 | A |
| Ex. 2-20 | 100 | 3 | 85 | 85 | 93 | 2.10 | A |

TABLE 3-2

| | Coating liquid viscosity (mPa · s) | Evaluation of offensive odor | Ozone resistance Magenta | Ozone resistance Cyan | Light resistance | Optical density | Bronzing |
|---|---|---|---|---|---|---|---|
| Comp. Ex. 2-1 | 50 | 1 | 85 | 85 | 89 | 2.50 | A |
| Comp. Ex. 2-2 | Gelled | — | — | — | — | — | — |
| Comp. Ex. 2-3 | Gelled | — | — | — | — | — | — |
| Comp. Ex. 2-4 | 100 | 3 | 65 | 67 | 89 | 2.20 | A |
| Comp. Ex. 2-5 | 80 | 3 | 85 | 85 | 90 | 2.15 | C |
| Comp. Ex. 2-6 | Gelled | — | — | — | — | — | — |

Tables 2-1 to 2-3 and Tables 3-1 to 3-2 indicate that the inkjet recording medium of Examples, which are within the scope of the second aspect, suppressed generation of the offensive odor, exhuibited excellent ozone resistance, and suppressed bronzing. Tables 2-1 to 2-3 and Tables 3-1 to 3-2 further indicate that the combination of the chloride ion-containing zirconium salt and the hydroxy acid derivative may suppress increase of the viscosity of the coating liquid for forming the ink-receiving layer.

All publications, patent applications, and technical standards mentioned in this specification are herein incorporated by reference to the same extent as if such individual publication, patent application, or technical standard was specifically and individually indicated to be incorporated by reference. It will be obvious to those having skill in the art that many changes may be made in the above-described details of the preferred embodiments of the present invention. It is intended that the scope of the invention be defined by the following claims and their equivalents.

What is claimed is:

1. An inkjet recording medium comprising an ink-receiving layer, the ink-receiving layer comprising fumed silica, a hydroxycarboxylic acid ester having an I/O value of 1.5 or more as determined in accordance with an organic conceptual diagram, and a polyvinyl alcohol, and an amount of the hydroxycarboxylic acid ester with respect to 1 kg of the fumed silica in the ink-receiving layer being from 0.1 moles to 2 moles.

2. The inkjet recording medium of claim 1, wherein the hydroxycarboxylic acid ester comprises at least one of a lactic acid ester or a glycolic acid ester.

3. The inkjet recording medium of claim 1, wherein the hydroxycarboxylic acid ester comprises an alkyl ester formed from an alcohol having 1 to 4 carbon atoms and one of a lactic acid or a glycolic acid.

4. A method for forming the inkjet recording medium of claim 1, the method comprising:

adding the hydroxycarboxylic acid ester having an I/O value of 1.5 or more as determined in accordance with an organic conceptual diagram and the polyvinyl alcohol to a silica dispersion comprising the fumed silica to prepare a coating liquid in which the amount of the hydroxycarboxylic acid ester is from 0.1 moles to 2 moles with respect to 1 kg of the fumed silica; and applying the coating liquid to a support to form an ink-receiving layer.

5. An inkjet recording medium comprising a support and an ink-receiving layer provided on the support, the ink-receiving layer comprising a chloride ion-containing zirconium salt, a water-soluble aluminum salt, a hydroxy acid derivative, inorganic fine particles, and a water-soluble resin.

6. The inkjet recording medium of claim 5, wherein the ink-receiving layer further comprises a basic compound.

7. The inkjet recording medium of claim 5, wherein the mass ratio of the content of the hydroxy acid derivative to the content of the chloride ion-containing zirconium salt is from 0.01 to 5.

8. The inkjet recording medium of claim 5, wherein the chloride ion-containing zirconium salt is zirconyl hydroxychloride or zirconium oxychloride.

9. The inkjet recording medium of claim 5, wherein the mass ratio of the content of the chloride ion-containing zirconium salt to the content of the inorganic fine particles (chloride ion-containing zirconium salt/inorganic fine particles) is from 0.001 to 0.1.

10. The inkjet recording medium of claim 5, wherein the mass ratio of the content of the water-soluble aluminum salt to the content of the inorganic fine particles is from 0.001 to 0.1.

11. The inkjet recording medium of claim 5, wherein the ink-receiving layer further comprises an ammonium salt.

12. The inkjet recording medium of claim 5, wherein the ink-receiving layer further comprises a basic compound, and the ratio of the content of the basic compound relative to the total solid content of the ink-receiving layer is from 0.1% by mass to 5% by mass.

13. The inkjet recording medium of claim 5, wherein the hydroxy acid derivative is a monovalent or divalent carboxylic acid having 2 to 10 carbon atoms and 1 to 4 hydroxyl groups or an ester of the monovalent or divalent carboxylic acid.

14. The inkjet recording medium of claim 5, wherein the hydroxy acid derivative comprises at least one selected from the group consisting of lactic acid, glycolic acid, quinic acid, 2,2-bis(hydroxymethyl)propionic acid, 2,2-bis(hydroxymethyl)butanoic acid, and glyceric acid, and esters thereof.

15. A method for preparing the inkjet recording medium of claim 5, the method comprising:

applying a coating liquid comprising the chloride ion-containing zirconium salt, the water-soluble aluminum salt, the hydroxy acid derivative, the inorganic fine particles, and the water-soluble resin to a support to form a coating layer; and applying a solution containing a basic compound to the coating layer, either (1) simultaneously with the application of the coating liquid or (2) before the applied coating liquid exhibits a falling-rate drying during drying of the applied coating liquid.

* * * * *